US009278552B2

(12) United States Patent
Teshigawara et al.

(10) Patent No.: US 9,278,552 B2
(45) Date of Patent: Mar. 8, 2016

(54) INK JET PRINTING APPARATUS AND CONTROL METHOD THEREOF

(71) Applicant: CANON KABUSHIKI KAISHA, Tokyo (JP)

(72) Inventors: Minoru Teshigawara, Saitama (JP); Yoshiaki Murayama, Tokyo (JP); Masahiko Umezawa, Kawasaki (JP); Shinsuke Ikegami, Tokyo (JP); Kiichiro Takahashi, Yokohama (JP); Takuya Fukasawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 42 days.

(21) Appl. No.: 13/909,332

(22) Filed: Jun. 4, 2013

(65) Prior Publication Data

US 2013/0328957 A1 Dec. 12, 2013

(30) Foreign Application Priority Data

Jun. 6, 2012 (JP) ..... 2012-128895
Nov. 28, 2012 (JP) ..... 2012-260071

(51) Int. Cl.
*B41J 3/60* (2006.01)
*B41J 29/393* (2006.01)
*B41J 11/00* (2006.01)
*B41J 2/21* (2006.01)

(52) U.S. Cl.
CPC ..... *B41J 11/008* (2013.01); *B41J 2/2146* (2013.01)

(58) Field of Classification Search
CPC .. B41J 2/04505; B41J 2/2135; B41J 2/04503; B41J 2/04506; B41J 2/2146; B41J 11/008; B41J 3/60; B41J 15/00; B41J 15/06; B41J 29/28; B41J 29/293; B41J 2/04596; B41J 2/04598
USPC ..... 347/5, 9, 14, 15, 19
See application file for complete search history.

(56) References Cited

U.S. PATENT DOCUMENTS 5,448,274 A 9/1995 Hirabayashi et al.
5,704,282 A * 1/1998 Khalid ..... 101/93.01
5,847,729 A 12/1998 Takahashi et al.
6,158,836 A 12/2000 Iwasaki et al.
6,168,261 B1 1/2001 Miyake et al.
6,174,039 B1 1/2001 Miyake et al.

(Continued)

FOREIGN PATENT DOCUMENTS

JP 2004-330771 A 11/2004
JP 2002-321342 A 11/2012

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

The ink jet printing apparatus, wherein, to print images on a printing medium, a plurality of print heads, each of which includes an ejection port array provided by arranging multiple ink ejection ports in a widthwise direction of the printing medium, are arranged in a conveying direction of the printing medium, including: a unit for detecting a printing position displacement with respect to a printing position of a reference print head on the printing medium for each of remaining print heads excluding the reference print head which is one of the plurality of print heads; and a unit for adding non-image data corresponding to the printing position displacement to print data to be printed by the plurality of print heads, so as to align the printing positions of the plurality of print heads.

25 Claims, 18 Drawing Sheets

(56) References Cited

U.S. PATENT DOCUMENTS

| | | | | |
|---|---|---|---|---|
| 6,229,594 | B1 * | 5/2001 | Inoue | 355/50 |
| 6,264,305 | B1 | 7/2001 | Inui et al. | |
| 6,328,403 | B1 | 12/2001 | Iwasaki et al. | |
| 6,352,327 | B1 | 3/2002 | Yano et al. | |
| 6,629,743 | B2 | 10/2003 | Chikuma et al. | |
| 6,793,304 | B2 | 9/2004 | Kasahara | |
| 6,997,541 | B2 | 2/2006 | Edamura et al. | |
| 7,258,429 | B2 | 8/2007 | Takahashi et al. | |
| 7,396,099 | B2 | 7/2008 | Teshigawara et al. | |
| 7,401,882 | B2 | 7/2008 | Umezawa | |
| 7,458,655 | B2 | 12/2008 | Takahashi et al. | |
| 7,500,727 | B2 | 3/2009 | Takahashi | |
| 8,251,480 | B2 | 8/2012 | Moriyama et al. | |
| 8,328,311 | B2 | 12/2012 | Nakano et al. | |
| 2007/0263244 | A1 * | 11/2007 | Sugitani et al. | 358/1.15 |
| 2009/0079779 | A1 * | 3/2009 | Saga | 347/16 |
| 2010/0123752 | A1 * | 5/2010 | Eun et al. | 347/19 |
| 2011/0032296 | A1 | 2/2011 | Nakano et al. | |
| 2011/0211008 | A1 * | 9/2011 | Teshigawara et al. | 347/16 |
| 2012/0033006 | A1 | 2/2012 | Murayama et al. | |
| 2012/0236056 | A1 * | 9/2012 | Ito | 347/14 |
| 2013/0100189 | A1 | 4/2013 | Azuma et al. | |

* cited by examiner

INK JET PRINTING APPARATUS AND CONTROL METHOD THEREOF

BACKGROUND OF THE INVENTION

1. Field of the Invention

The present invention relates to an ink jet printing apparatus and control method thereof. In particular, the present invention relates to a method for correcting printing position displacement for an ink jet printing apparatus wherein a plurality of ejection port arrays are aligned each being extended in the widthwise direction of continuous printing paper such as rolled paper, and the printing of an image is performed on the continuous printing paper.

2. Description of the Related Art

In a color ink jet printing apparatus which uses a full-line head, a plurality of ejection port arrays which are used to eject inks in different colors are arranged at predetermined intervals in a direction in which a printing medium is to be conveyed. Therefore, when print dots are formed at one position of the printing medium, timings for ejecting ink must be shifted for the individual ejection port arrays. In order to adjust the ink ejection timings, there is a well known method that null data which represents no ejection of ink is added to print data which is to be printed the individual ejection port arrays, while the amount of null data to be added differs, depending on the ejection port arrays.

Generally, the null data is set by a unit of predetermined bits so as to be easily processed by a CPU. Accordingly, the intervals of the ejection port arrays are also set as enable the adjustment of the ink ejection timings, and thus, it is difficult to set the interval of ejection port arrays arbitrarily.

In Japanese Patent Laid-Open No. 2004-330771, in order to set an arbitrary interval of the individual ejection port arrays, a method that null data which differs in volume is added to the individual ejection port arrays, and a start address for reading the null data is changed in accordance with the positioning of the ejection port arrays is disclosed. According to the method disclosed in Japanese Patent Laid-Open No. 2004-330771, when the null data that is added is a multiple of the unit of predetermined bits, the reading of the null data can still be started at a proper address in the middle of the unit of bits, and therefore, a plurality of ejection port arrays can be set at arbitrary intervals.

Incidentally, the ink jet printing apparatus has conveying means (a conveying mechanism) for conveying printing media. There are cases that change have occurred on the surfaces of conveying rollers which are used as conveying means, and the change have caused the distances in which printing media were conveyed to fluctuate, and as a result, the printing positions were shifted. Furthermore, the conveyance amounts of printing media are changed by the moisture content of the printing media themselves.

According to the arrangement described in Japanese Patent Laid-Open No. 2004-330771, the positions of the ejection port arrays are used as reference positions when setting fixed start addresses for reading print data for the individual ejection port arrays. Therefore, in a case that the distance that a printing medium is conveyed is altered as a consequence of the condition of either the conveying means or of the printing medium, the ink ejection timing can not be appropriately adjusted. There is another adjustment method whereby the ink ejection timing can be changed during the printing of a print medium, but when this method is employed to adjust the printing start positions of the individual ejection port arrays, the transfer of ejection port drive data need to be temporarily halted. Accordingly, the printing operation also needs to be halted, and as a result, a great deal of time is required to complete the printing.

SUMMARY OF THE INVENTION

The present invention provides an ink jet printing apparatus and control method thereof which can correct printing position displacement for ejection port arrays by adjusting printing starting position of each ejection port arrays, even if a conveyance error arises.

According to the present invention, an ink jet printing apparatus, wherein, to print images on a printing medium, a plurality of print heads, each of which includes an ejection port array provided by arranging multiple ink ejection ports in a widthwise direction of the printing medium, are arranged in a conveying direction of the printing medium, comprising:

a unit for detecting a printing position displacement with respect to a printing position of a reference print head on the printing medium for each of remaining print heads excluding the reference print head which is one of the plurality of print heads; and a unit for adding non-image data corresponding to the printing position displacement to print data to be printed by the plurality of print heads, so as to align the printing positions of the plurality of print heads.

Furthermore, according to the present invention, a control method for an ink jet printing apparatus, wherein, to print images on a printing medium, a plurality of print heads, each of which includes an ejection port array provided by arranging multiple ink ejection ports in a widthwise direction of the printing medium, are arranged in a conveying direction of the printing medium, comprising:

a step of detecting a printing position displacement with respect to a printing position of a reference print head on the printing medium for each of remaining print heads excluding the reference print head which is one of the plurality of print heads; and a step of adding non-image data corresponding to the printing position displacement to print data to be printed by the plurality of print heads, so as to align the printing positions of the plurality of print heads.

According to the above described arrangement, one of a plurality of print heads is used as a reference print head, a printing position displacement that is relative to printing position of the reference print head is detected for remaining print heads, and non-image data corresponding to the printing position displacement are added to print data. As a result, the printing positions of all of the print heads can be matched. Therefore, according to the present invention, even when an error occurs within the distance in which the printing medium is conveyed, the print start positions of the ejection port arrays, which are provided for the individual print heads, can be adjusted to their desired positions. Thus, in this invention, the printing position displacement for the individual ejection port arrays can be appropriately corrected.

Further features of the present invention will become apparent from the following description of exemplary embodiments (with reference to the attached drawings).

DESCRIPTION OF THE EMBODIMENTS

Figure 1:
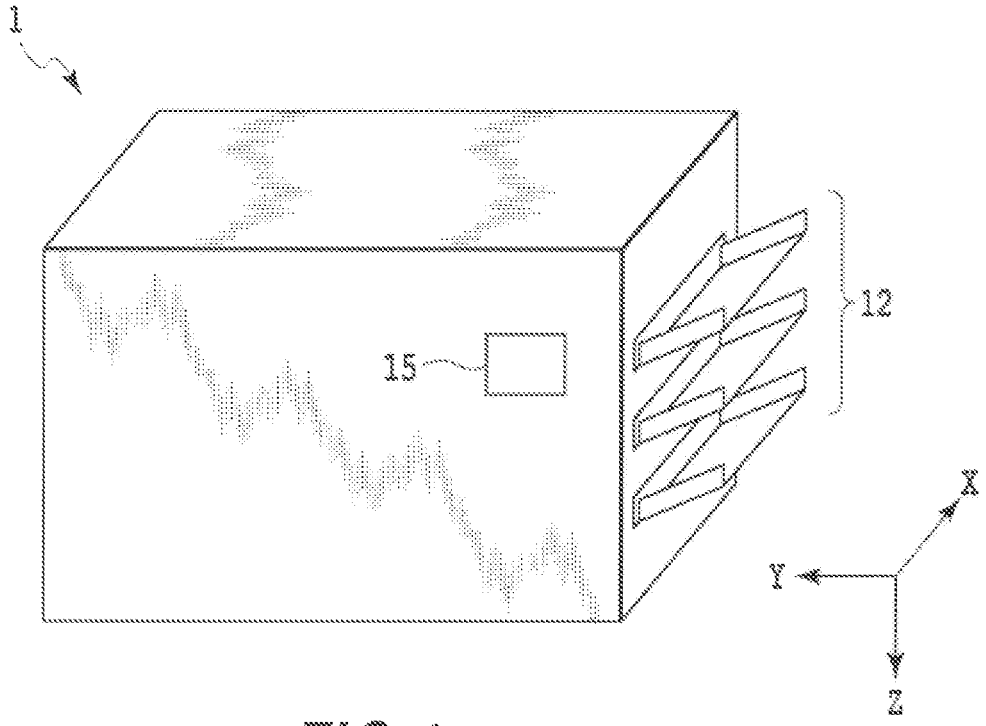
FIG. 1 is a diagram illustrating the external appearance of an ink jet printing apparatus according to a first embodiment of the present invention.

The embodiments of the present invention will now be described in detail while referring to the drawings.

First Embodiment

FIG. 1 is a diagram illustrating the external appearance of an ink jet printing apparatus 1 (hereinafter referred to as a "printing apparatus 1") according to a first embodiment of the present invention. As shown in FIG. 1, a sheet discharging unit 12 and an operating unit 15 are provided for the printing apparatus 1. When a printing medium 3 has been printed based on print data, the printing medium 3 is discharged and placed on the sheet discharging unit 12. A user uses various switches provided on an operating unit 15, to enter various commands such as designation of the size of the printing medium 3 and switching the on-line and the off-line of the printing apparatus 1, into the printing apparatus 1.

Figure 2:
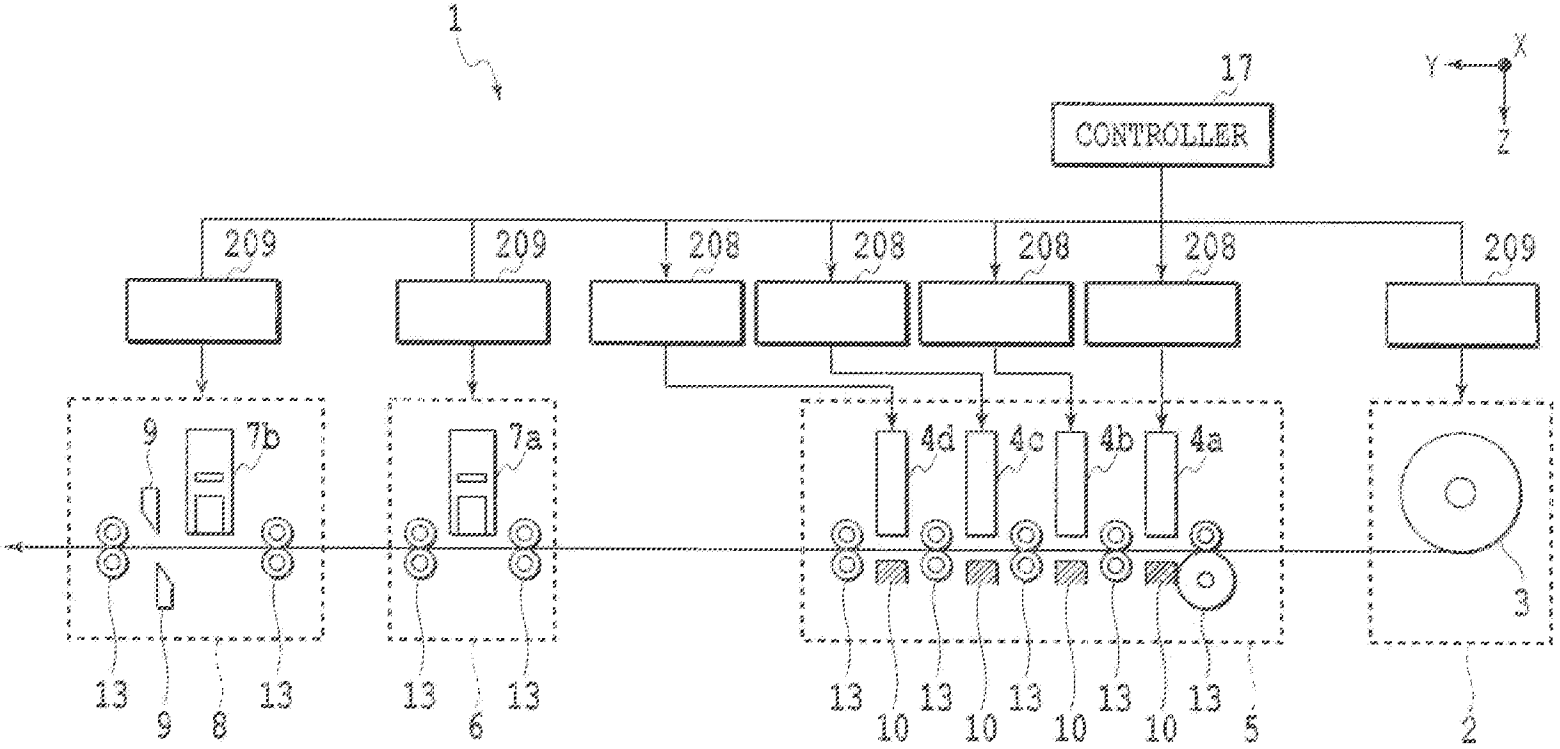
FIG. 2 is a cross-sectional view of the internal arrangement of the ink jet printing apparatus.

FIG. 2 is a cross-sectional view of the internal arrangement of the printing apparatus 1. As shown in FIG. 2, the printing apparatus 1 includes a sheet feeding unit 2, a printing unit 5, an inspection unit 6 and a cutting unit 8. In this embodiment, the sheet feeding unit 2 pulls the printing medium 3 that is maintained as a roll, and feeds the printing medium 3 to the printing unit 5 which is located downstream in the conveying direction (Y direction shown in FIG. 2).

The printing unit 5 prints a test pattern that is not related to an image and an image forming process, and that is used to examine displacement of the printing position, on the printing medium 3 conveyed from the sheet feeding unit 2. The printing unit 5 also prints other patterns, such as a cut mark pattern which is used as a guide mark when cutting the printing medium 3 to a predetermined size, a flashing pattern which is used to maintain the ink ejection states of the individual ejection ports, and an ejection port test pattern.

The pattern for examining the displacement of the printing position may also be printed together with a pattern that has a different function, and in such a case, when there is a portion in the cut mark pattern region that is not used for mark detection, a test pattern for examining the displacement of a printing position is printed on that portion. That is, when a plurality of patterns is arranged so that the space may be used efficiently, the area required for a non-image portion can be reduced.

The printing unit 5 includes print heads 4*a* to 4*d* for ejecting ink of different colors, and ejection port arrays are provided for the print heads 4*a* to 4*d* in the widthwise direction of the printing medium 3. Multiple ejection opening arrays are located in the direction in which the printing medium 3 is to be conveyed. Each of these ejection opening arrays consists of a plurality of ejection ports, and when ink is ejected through these ejection ports, printing of the medium 3 is performed. The print heads 4*a* to 4*d* will be described in detail later.

The printing unit 5 also includes a conveying mechanism 13 that conveys the printing medium 3. The conveying mechanism 13 has a plurality of pairs of conveying rollers to support the printing medium 3 between the individual conveying roller pairs. Platens 10 are located between each two of the conveying roller pairs, and include a support face, with which the reverse face of the printing medium 3 is supported. The same conveying mechanism 13 is included in the inspection unit 6 and in the cutting unit 8. The print heads 4*a* to 4*d*, the conveying mechanism 13 and the platens 10 are stored in a single housing.

The inspection unit 6 includes a scanner 7*a*, which reads images and test patterns printed by the printing unit 5. The information obtained by reading is transmitted to a controller 17, which then, for example, examines the ejection states of the ejection ports of the print heads 4*a* to 4*d*, the state in which the printing medium 3 is being conveyed, and the printing positions.

The scanner 7*a* includes a light emitting portion and an image pickup element (neither of them shown). The light emitting portion is located at a position to emit light to the reading direction of the scanner 7*a*, or at a position to emit light onto the scanner 7*a* through the printing medium 3 which is located in therebetween. In the former position case, the reflected light of the light emitted by the light emitting portion is received by the image pickup element, and in the latter position case, the light that has been emitted by the light emitting portion and has passed the printing medium 3 is received by the image pickup element. The image pickup element converts the received light into an electric signal, and outputs the electric signal. An example image pickup element can be a Charge Coupled Device (CCD) image sensor, or a Complementary Metal Oxide Semiconductor (CMOS) image sensor.

In this embodiment, the printing unit 5 prints a test pattern, not related to image forming, in the non-image area of the printing medium 3. The inspection unit 6 reads and analyzes the test pattern, and measures the displacement of the printing positions for the ejection port arrays that are provided for the print heads 4*a* to 4*d*. When the measurement results are transmitted as feedback to a CPU 201 that will be described later, the printing start positions for print data can be appropriately corrected for the individual print heads 4*a* to 4*d*, and the printing position displacement for the ejection port arrays can be corrected. The printing position displacement may be determined based on the results of one measurement, or a plurality of measurements may be performed, and the measurement results may be calculated, e.g., may be averaged to determine the displacement.

The cutting unit 8 includes a scanner 7*b* having the same structure as the scanner 7*a*, and a pair of cutting mechanisms 9 that cut off the printing medium 3. The scanner 7*b* reads a cut mark pattern, printed on the printing medium 3 by the printing unit 5, and ascertains a cutting position, and the cutting mechanisms 9 sandwich the printing medium 3 and cut off the printing medium 3.

Thereafter, the printing medium 3 is conveyed to a drying unit (not shown) to dry the ink applied on the printing medium 3. The drying unit employs a method in which hot air is blown on the printing medium 3, or a method which the printing medium 3 is irradiated by an electromagnetic wave such as an ultraviolet ray or an infrared ray, to dry the ink on the printing medium 3. The printing medium 3, after being dried by the drying unit, is conveyed along a conveying path that is passed through below the printing unit 5, and is discharged to a sheet discharging unit 12.

When the conveying, printing, inspecting, cutting, drying, and discharging procedures described above have been performed for the printing medium 3, the product on which image was printed can be obtained. The above described operation is controlled by the controller 17, which will be descried later.

Figure 3:
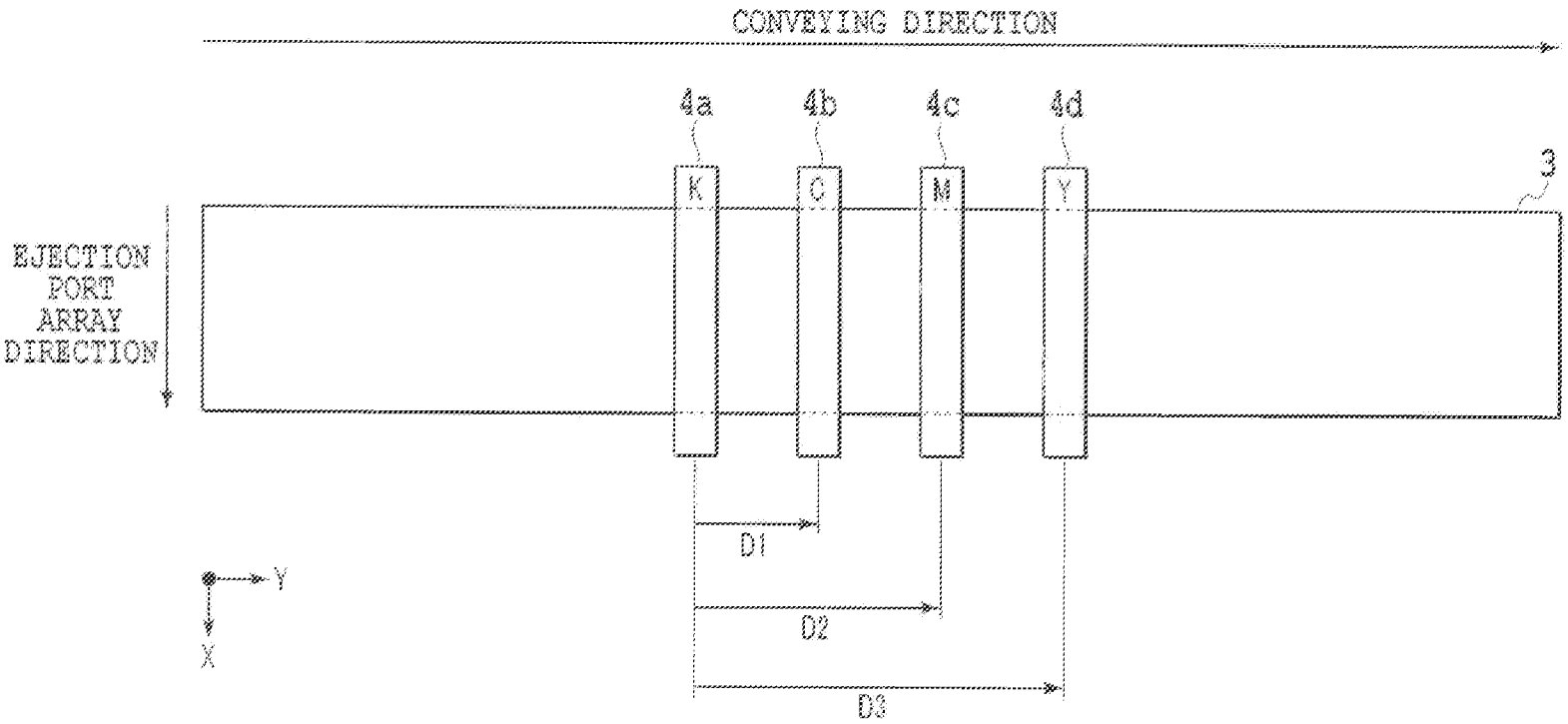
FIG. 3 is a schematic view illustrating mutual movements of print heads and a printing medium.

The print heads 4*a* to 4*d* will now be described. FIG. 3 illustrates the relative movements of the print heads 4*a* to 4*d* and the printing medium 3, and illustrates a top view of the outline of near the section of the printing unit 5 shown in FIG. 2. The printing apparatus 1 includes the full-line print heads 4*a* to 4*d* that are respectively arranged to cover the printing medium 3 in the widthwise direction. As shown in FIG. 3, the print heads 4*a* to 4*d* are located in a direction in which the printing medium 3 is to be conveyed, in the order of the print head 4*a*, the print head 4*b*, the print head 4*c*, and the print head 4*d*, beginning from upstream in the conveying direction. Therefore, in the order corresponding to the arrangement of these print heads 4*a* to 4*d*, images are printed on the printing medium 3.

Next, the printing unit 5 of the printing apparatus 1 in FIG. 1 will be described while referring to FIG. 15. The printing unit 5 includes print heads 4*a* to 4*d* of four colors, black (K), cyan (C), magenta (M) and yellow (Y). Since the structure of these print heads 4*a* to 4*d* are same, one of the print heads 4*a* to 4*d*, i.e., the print head 4*a*, is employed as an example for the description in FIG. 15.

Figure 15:
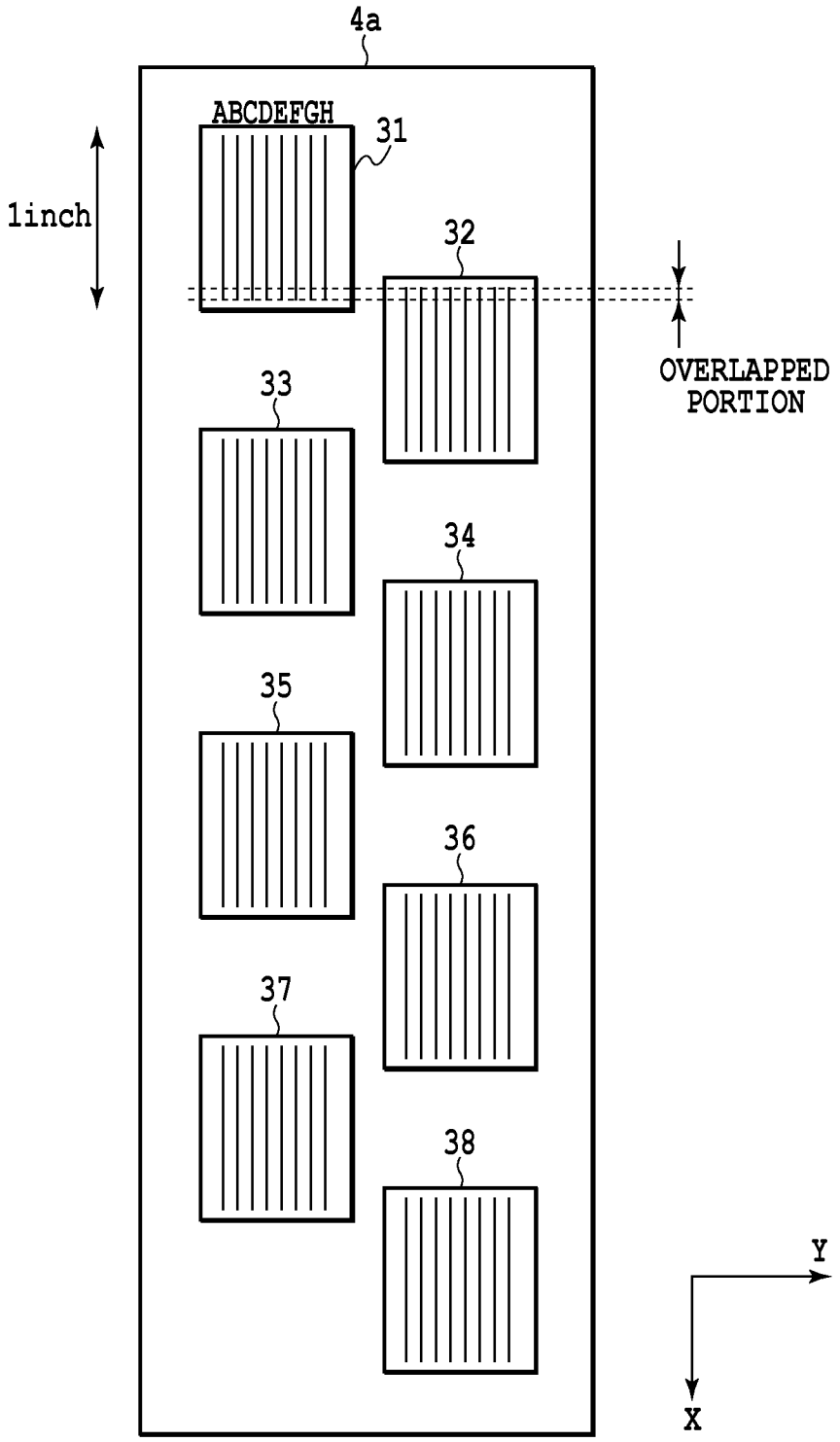
FIG. 15 is a structural diagram for explaining an example print head.

In FIG. 15, a sheet conveying direction is defined as the direction Y, and a direction perpendicular to the sheet conveying direction (a direction in which ejection ports are arranged) is defined as a direction X. In the following drawings, the same definitions are employed for the direction X and the direction Y.

For the print head 4*a*, eight printing element substrates 31 to 38 (hereinafter, referred to also as chips) which are formed of silicon to provide the effective ejection width of about one inch, are provided for a base substrate (support member) in a staggered arrangement. The electrode portions (not shown) at both ends in the direction X are electrically connected to a flexible wire substrate by wire bonding.

For the individual chips 31 to 38, a plurality of ejection port arrays, each of which is provided by aligning a plurality of ejection ports in the direction Y, are arranged in parallel to each other. More specifically, eight ejection port arrays (an ejection port array A, an ejection port array B, an ejection port array C, an ejection port array D, an ejection port array E, an ejection port array F, an ejection port array G and an ejection port array H) are arranged in parallel to each other. The chips 31 to 38 are overlapped at a distance equivalent to a predetermined number of ejection ports. That is, adjacent chips are arranged so as to partially overlap in the direction Y (the ejection port arrangement direction).

Furthermore, for example, a temperature sensor (not shown) for measuring the temperature of a chip is also provided for the individual chips 31 to 38. For example, a printing element (heater) which is a heating resistor element is provided for the individual ejection ports. When the printing elements generate heat by receiving electricity, bubbles are formed in a liquid, and the obtained energy is used to eject the liquid from the ejection ports. The ink ejection method can be used, for example, a method using piezoelectric elements, a method using electrostatic elements, or a method using MEMS elements, at other than a method using heating resistors elements.

Ink tanks (not shown) for supplying ink of different colors are connected to the print heads 4*a* to 4*d*, respectively, so that color inks can be supplied from the ink tanks via ink tubes (not shown) to the corresponding print heads 4*a* to 4*d*. In this embodiment, black ink (K) is ejected from the ejection ports of the print head 4*a*, cyan ink (C) is ejected from the ejection ports of the print head 4*b*, magenta ink (M) is ejected from the ejection ports of the print head 4*c*, and yellow ink (Y) is ejected from the ejection ports of the print head 4*d*.

FIG. 3 is a schematic top view of the section near the printing unit 5 in FIG. 2, illustrating the positional relationship between the print heads 4*a* to 4*d* and the printing medium 3. The printing apparatus 1 includes the full-line print heads 4*a* to 4*d* arranged to cover the printing medium 3 in the widthwise direction. As shown in FIG. 3, the print heads 4*a* to 3*d* are located in the direction in which the printing medium 3 is to be conveyed, in the order of the print head 4*a*, the print head 4*b*, the print head 4*c* and the print head 4*d*, beginning from upstream in the conveying direction. Therefore, in the order corresponding to the arrangement of these print heads 4*a* to 4*d*, images are printed on the printing medium 3.

In this embodiment, the four print heads 4*a* to 4*d* corresponding to ink of four colors (KCMY) are provided in printing apparatus 1; however, the number of ink colors and the number of print heads are not limited to those four. Further, in this embodiment, the effective ejection width of the individual print heads 4*a* to 4*d* is 8 inches, which is substantially the same length as the short side of a A4 size printing sheet. That is, printing of an image can be completed by one-pass scanning. However, the effective ejection width of the print heads is not limited to this length, and an arbitrary width may be used so long as printing by one-pass scanning can be performed for a sheet having the maximum width that can be conveyed by the conveying mechanism.

In FIG. 3, distances D1 to D3 represents printing position displacements (distances between dots) with respect to the printing medium 3 for the ejection port arrays of the print heads when dots were ejected at the same timing. This data is detected, as needed, by the inspection unit 6, and is stored in advance in a predetermined memory (a ROM 202 or an HDD 204, which will be described later). The printing position displacement between the ejection port arrays occurs not only due to the intervals between the ejection port arrays of the print heads 4*a* to 4*d*, but also due, for example, to the ejection angles of the print heads 4*a* to 4*d*, the time which is required to landing of the ink to the printing medium 3 from the ejection of ink, and fluctuations in the distance in which the printing medium 3 is conveyed.

Therefore, while taking these correlations into account, a printing position displacement between the print head 4*a* and the print head 4*b* is set as the distance D1, a printing position displacement between the print head 4*a* and the print head 4*c* is set as the distance D2, and a printing position displacement between the print head 4*a* and the print head 4*d* is set as the distance D3. When printing is actually performed for the printing medium 3, the ink ejection timings are corrected by taking the distances D1 to D3 into account. The correction process will be described later.

Figure 4:
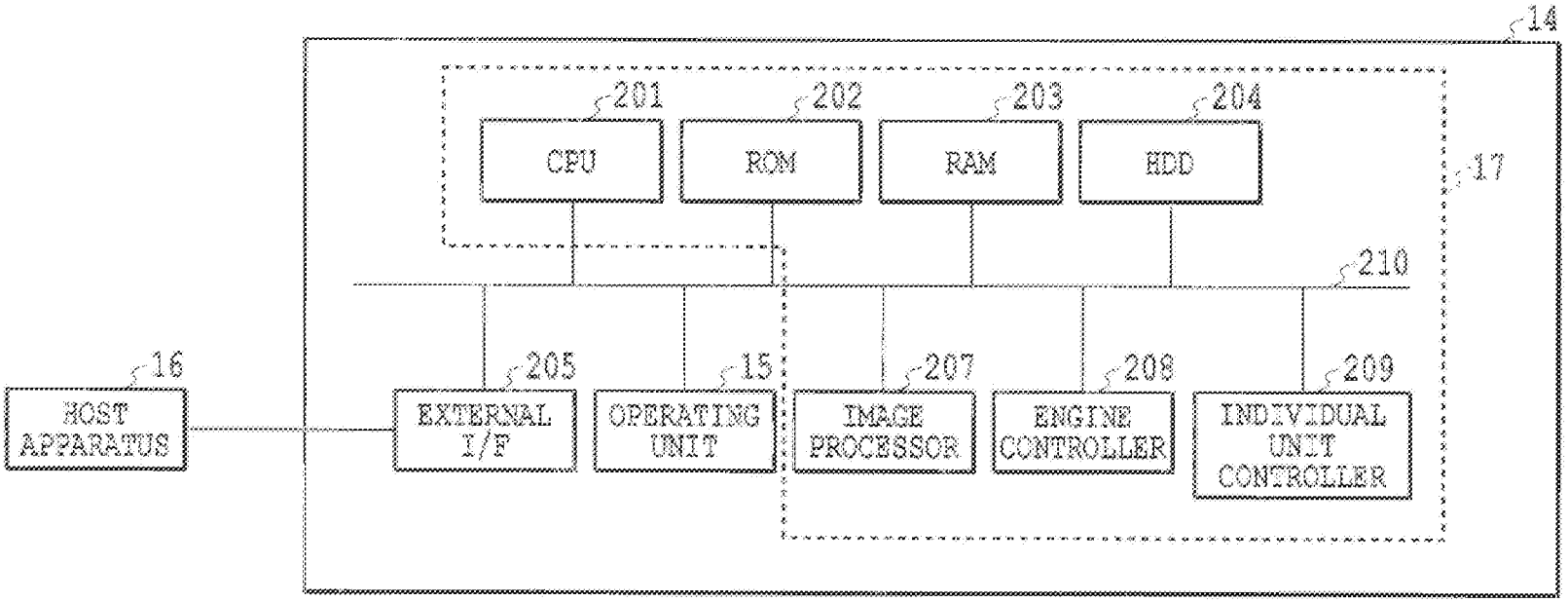
FIG. 4 is a block diagram illustrating the control system of the ink jet printing apparatus.

FIG. 4 is a block diagram illustrating the control system of the printing apparatus 1. As shown in FIG. 4, a control unit 14 is connected to a host apparatus 16 via an external interface 205. The control unit 14 includes the controller 17 and the operating unit 15, in addition to the external interface 205. The controller 17 employs an engine controller 208 and an individual unit controller 209 to control, for example, the sheet feeding unit 2, the printing unit 5, the inspection unit 6, the cutting unit 8 and the conveying mechanism 13.

Specifically, the controller 17 performs various control processes. As shown in FIG. 4, the controller 17 includes the CPU 201, the ROM 202, a RAM 203, the HDD 204, an image processor 207, the engine controller 208 and the individual unit controller 209. The CPU 201 executes various programs to perform general control for various operations. The ROM 202 is used to store various programs to be executed by the CPU 201, as well as fixed data required for various operations performed by the printing apparatus 1. The RAM 203 is used as a work area for the CPU 201 or as a temporary storage area for various received data. The RAM 203 is also used to store various setup data. The HDD 204 is used to store various programs, print data, and setup information that is required for various operations performed by the printing apparatus 1.

The image processor 207 performs image processing based on image data that is received from the host apparatus 16, and generates print data that can be printed by the print heads 4*a* to 4*d*. Specifically, the image processor 207 performs a color conversion process or a quantization process for the received image data, and also performs a resolution conversion, an image analysis, and an image correction, as needed. Print data obtained through the image processing is stored in the RAM 203 or the HDD 204.

The engine controller 208 uses a control command received from such as the CPU 201, and drives the print heads 4*a* to 4*d* of the printing unit 5 in accordance with the print data that is provided. The engine controller 208 also controls the conveying mechanism 13. The individual unit controller 209, which is a sub-controller, drives the sheet feeding unit 2, the inspection unit 6, the cutting unit 8, the drying unit and the sheet discharging unit based on control commands received from the CPU 201.

The operating unit 15 is an input/output interface with respect to a user, and includes an input unit and an output unit. The input unit has hardware keys and a touch panel that a user uses to enter an instruction, and the output unit is a display device or an audio generator that displays or releases information that is to be provided for a user. The external interface 205 is an interface for connecting the controller 17 to the host apparatus 16. The above described components are interconnected by a system bus 210.

The host apparatus 16 is an image data supply source. The printing apparatus 1 prints image data, supplied by the host apparatus 16, and obtains a product to be output. The host apparatus 16 may be either a general-purpose apparatus, such as a computer, or a dedicated image apparatus, such as an image capture apparatus having an image reader, a digital camera or a photo storage device. When a computer is used as the host apparatus 16, an operating system, application software and a printer driver for the printing apparatus 1 should be installed in the storage device of the computer. It should be noted that not all of the processes described above need be performed by software, and that one or all of the processes may be provided by hardware.

<Print Data>

Figure 5:
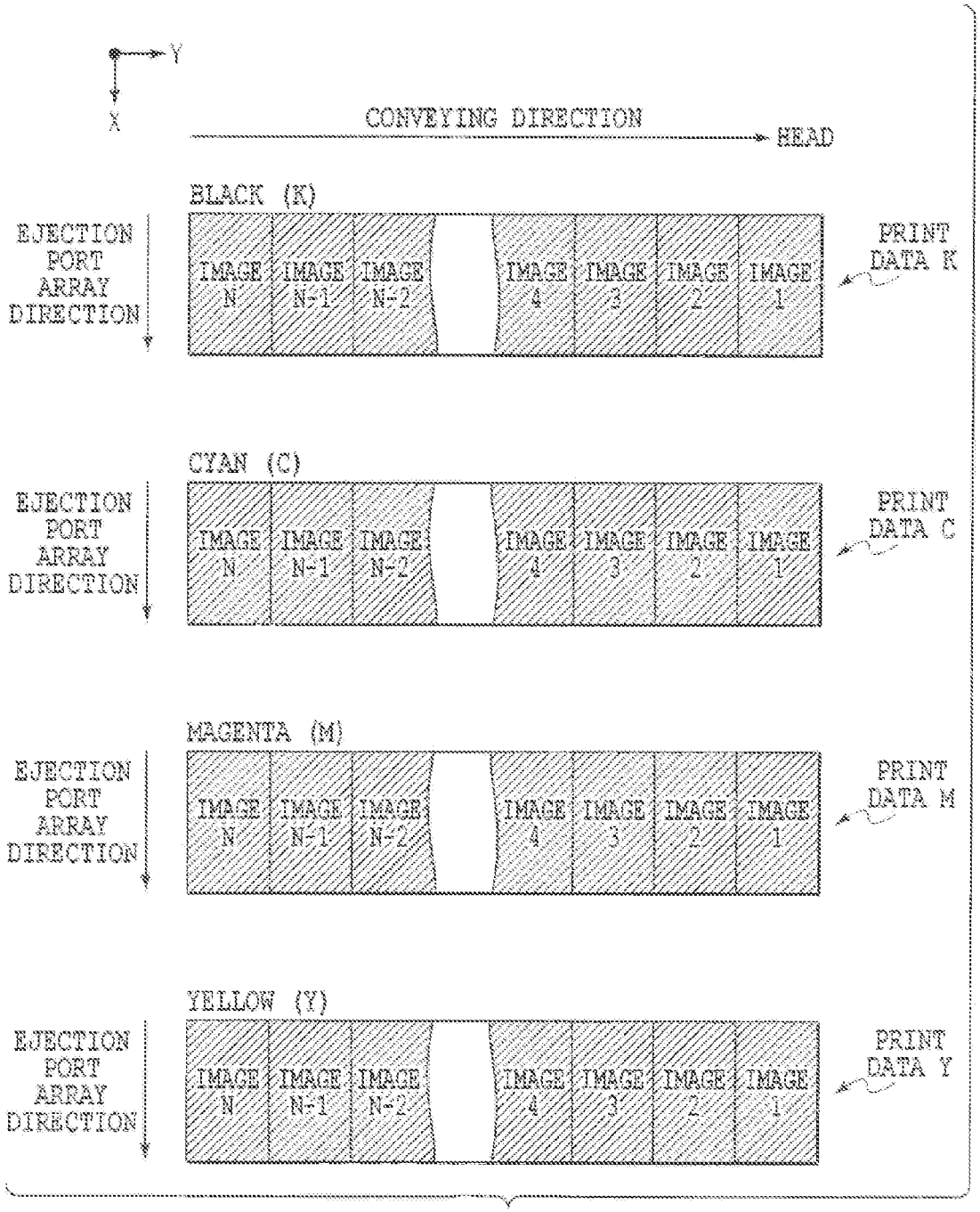
FIG. 5 is a schematic diagram illustrating the arrangement of images to be printed by the individual print heads.

FIG. 5 is a schematic diagram illustrating the arrangement of images to be printed by the individual print heads 4*a* to 4*d*, and print data K to Y are those to be printed by the print heads 4*a* to 4*d*, respectively. The print data K to Y are those obtained by performing, for image data, predetermined image processing and quantization processing, during which either a (1) representing the printing of a dot, or a (0) representing the absence of printing, is set for the individual pixels. As shown in FIG. 5, all the print heads 4*a* to 4*d* print images in the order image 1 to image N, and as explained while referring to FIG. 3, the printing of images is performed, in order, by the print heads 4*a* to 4*d*. That is, the printing of an image 1 is first performed by the print head 4*a*, and then, in order, by the print head 4*b*, the print head 4*c* and the print head 4*d*, and thus, the printing of the image 1 is completed.

When print data have been processed by the image processor 207 and have been stored in either the RAM 203 or the HDD 204, the CPU 201 reads the print data and transmits it to the engine controller 208, which, in turn, permits the print heads 4*a* to 4*d* to print corresponding images.

<Case which Null Data are Added to Print Data in Advance>

Figure 6:
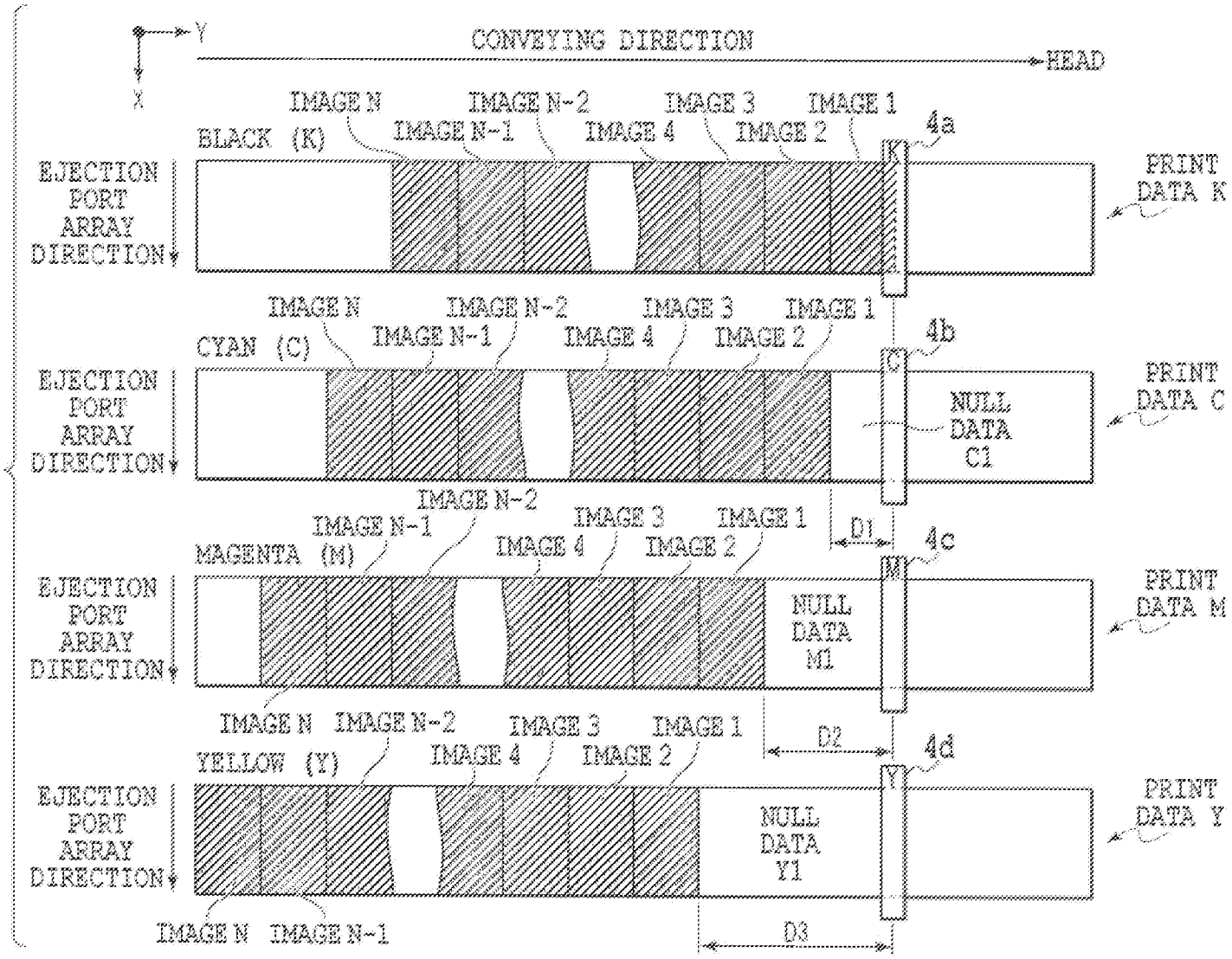
FIG. 6 is a schematic diagram illustrating print data to be printed by the print heads, to which null data has been added in advance.

FIG. 6 is a schematic diagram illustrating print data for the print heads 4*a* to 4*d*, for which null data have been added. As shown in FIG. 6, null data C1 to Y1, for each of which the number of lines corresponds to the distances D1 to D3, explained while referring to FIG. 3, are added to positions antecedent to the images 1 to be printed by the print heads 4*b* to 4*d*. In this case, one line indicates a region to be printed by a single ejection operation using one ejection port array, i.e., indicates a region that extends along the width of the printing medium, and has a width of one pixel. The addition of null data to the print head is performed by the CPU 201.

Figure 7:
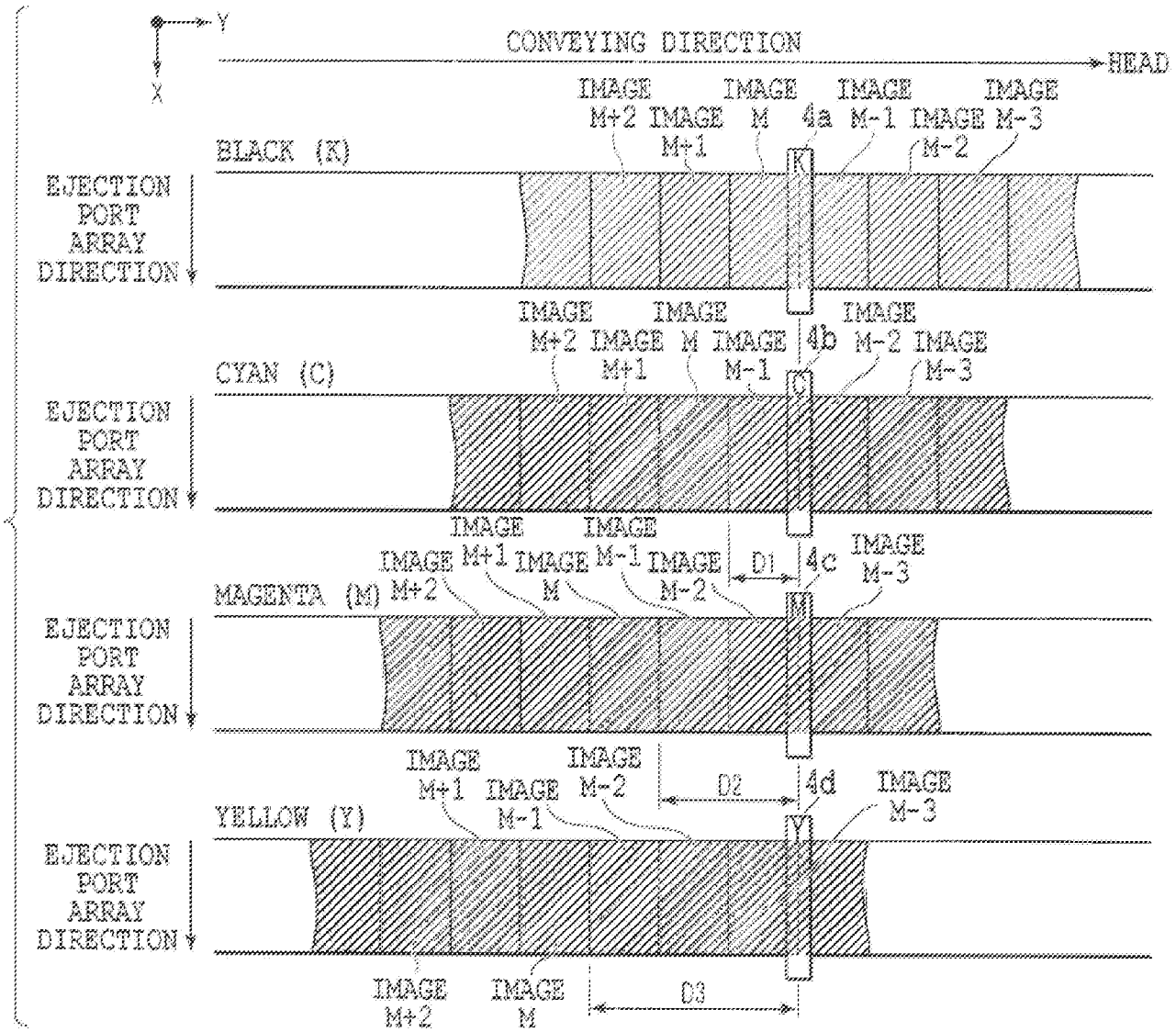
FIG. 7 is a schematic diagram illustrating printing timings in the state shown in FIG. 6.

FIG. 7 is a schematic diagram illustrating printing timings for print data shown in FIG. 6. Specifically, the timings for printing images M in FIG. 6 are schematically shown in FIG. 7, and a conveyance amount of the printing medium 3 is a desired distance.

As explained while referring to FIG. 6, in region antecedent to one image, null data C1, for which the number of lines corresponds to the distance D1, is added to print data C to be printed by the print head 4*b*. Therefore, printing position displacement between the print heads 4*a* and 4*b* can be adjusted by using the null data C1, and therefore, as shown in FIG. 7, the printing of the image M can be started at a position at the distance D1 from the printing start position of an image M−1, which precedes the image M. Similarly, as explained while referring to FIG. 6, antecedent to the image M, null data M1, for which the number of lines corresponds to the distance D2, is added to the print data M that is to be printed by the print head 4*c*. Therefore, as shown in FIG. 7, a printing position displacement between the print heads 4*a* and 4*c* can be adjusted by using the null data M1.

Likewise, for the print head 4*d*, as explained while referring to FIG. 6, antecedent to the image M, null data Y1, for which the number of lines corresponds to the distance D3, is added to the print data Y. Thus, as shown in FIG. 7, a printing position displacement between the print heads 4*a* and 4*d* can be adjusted by using the null data Y1.

As described above, in the case shown in FIG. 7, since the null data C1 to Y1 are added in advance to the print data C to Y, as shown in FIG. 6, the printing start positions for the images 1 of the print heads 4*a* to 4*d* can be matched. Furthermore, in the case shown in FIG. 7, since a conveyance amount of the printing medium 3 is a desired distance, a printing position displacement can be avoided that occurs when the conveying distance is changed. As described above, in a case that the conveyance amount of the printing medium 3 is desired distance, when the null data C1 to Y1, for which the number of lines corresponds to the distances D1 to D3, are added in advance to the print data C to Y, the printing start positions of the ejection port arrays for the individual print heads 4*a* to 4*d* can be adjusted.

As described above, in a case that the distance in which the printing medium 3 is conveyed is not changed, when predetermined null data is provided in advance for the print data, the ink ejection timings for the ejection port arrays can be adjusted, and the printing positions on the printing medium can be matched for the ejection port arrays. However, there is a case which the distance in which the printing medium 3 is conveyed might be changed. Therefore, even when null data is added in advance to the head of the print data, a fluctuation in the distance in which the printing medium 3 is conveyed will cause a printing position displacement of ejection port arrays, with respect to the printing medium 3.

Therefore, according to the embodiment, during the printing of the printing medium 3, a test pattern is printed in the non-image area, and is read by the inspection unit 6. Thereafter, the inspection unit 6 transmits the obtained information to the controller 17. Based on the information obtained by the inspection unit 6, the controller 17 calculates a printing position displacement between the ejection port arrays, and obtains data (non-image data/null data) for adjustment of the number of lines (the number of pixels) that corresponds to the displacement, and adds the data as an adjustment pattern between images to be printed by the individual print heads. As described above, in this embodiment, since the number of lines of the adjustment data to be added is appropriately adjusted in consonance with the displacement of the printing positions, the printing position displacement can be corrected even when the conveying distance is changed during the printing of the printing medium 3. A specific correction method for this embodiment will now be described.

<Case which a Conveying Distance is Shorter than a Desired Distance>

First, a case which the conveyance amount of the printing medium 3 is shorter than a desired distance will now be described. FIGS. 8A to 8D are schematic diagrams illustrating the print timings in a case that the conveyance amount of the printing medium 3 is shorter than that for the case shown in FIG. 7.

When the printing medium 3 has been conveyed the desired distance, the print head 4*b* starts the printing of the image M−1 at the time at which the print head 4*a* begins the printing of the head of the image M (see FIG. 7). However, in a case that the conveyance amount of the printing medium is shorter than the desired distance, at the time at which the print head 4*a* begins to print the head of the image M, the head of the image M−1, which is printed by the print head 4*a*, is positioned upstream of the location of the print head 4*b*.

Figures 8A, 8B, 8C, 8D:
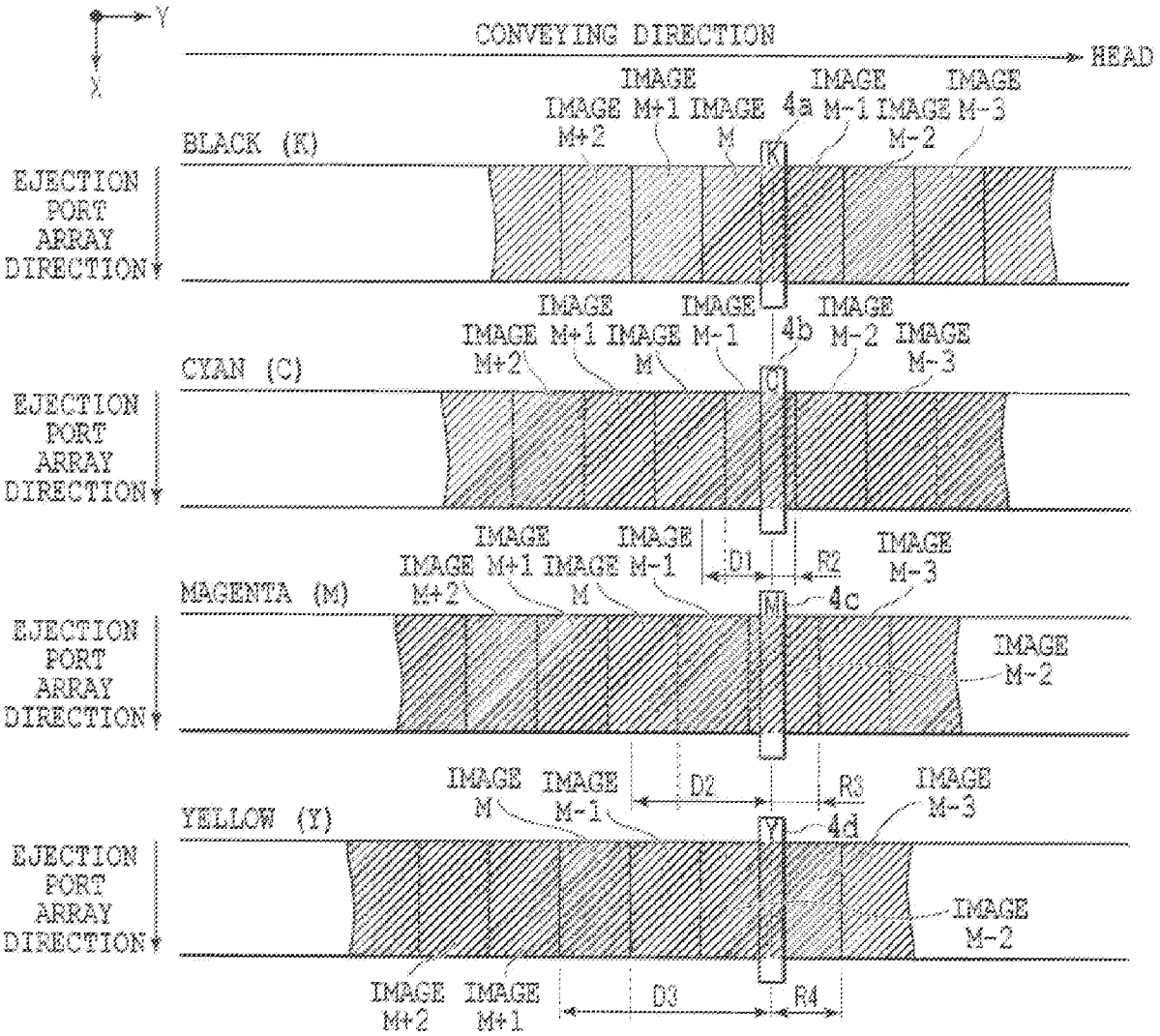
FIG. 8A is a schematic diagram illustrating printing timings in a case that a conveyance amount is shorter than in FIG. 7.
FIG. 8B is a schematic diagram illustrating printing timings in a case that the conveyance amount is shorter than that in FIG. 7.
FIG. 8C is a schematic diagram illustrating printing timings in a case that the conveyance amount is shorter than that in FIG. 7.
FIG. 8D is a schematic diagram illustrating printing timings in a case that the conveyance amount is shorter than that in FIG. 7.

When the head of the image M−1, printed by the print head 4*a*, is actually arranged at the printing position of the print head 4*b*, at this time the print head 4*b* has already printed R2 lines of the image M−1, as shown in FIG. 8B. Likewise, when the head of the image M−2 printed by the print head 4*a* is actually arranged at the printing position of the print head 4*c*, at this time the print head 4*c* has already printed R3 lines for the image M−2, as shown in FIG. 8C. Further, when the head of the image M−3 printed by the print head 4*a* is actually arranged at the printing position of the print head 4*d*, at this time the print head 4*d* has already printed R4 lines for the image M−3, as shown in FIG. 8D.

As shown in FIGS. 8A to 8D, in a case that the conveyance amount of the printing medium 3 is a shorter distance than the desired distance, the print heads 4*a* to 4*d* start the printing of the image M at positions located before the desired printing start positions for the image M. Therefore, when the print head 4*b* prints the image M, printing of the image M by the print head 4*b* is superimposed not only on the image M portion printed by the print head 4*a*, but also on the preceding image M−1 portion printed by the print head 4*a*. Such a printing position displacement also occurs for the print head 4*c*, and further, the print head 4*d* prints the image M on the image M−1 portion printed by the print head 4*a*.

In this embodiment, even when a printing position displacement has occurred, the printing positions can be adjusted to correct the printing position displacement, because adjustment data (null data) are added as an adjustment pattern for the print data.

Specifically, as described above, the test pattern printed by the printing unit 5 is read by the inspection unit 6, and based on the results, the amount of printing position displacement is measured, and thereafter, in order to correct for this displacement, the adjustment data are added to the print data which will be printed by the individual print heads. Further, in a case described in this embodiment wherein the conveyance amount of the printing medium 3 is shorter than a desired distance, a number of lines for adjustment data (null data) to be added prior to the image M is increased for a print head that is located further downstream, so that the printing timing for the image M can be delayed. In this manner, the printing start positions for all of the print heads are adjusted.

Figure 9:
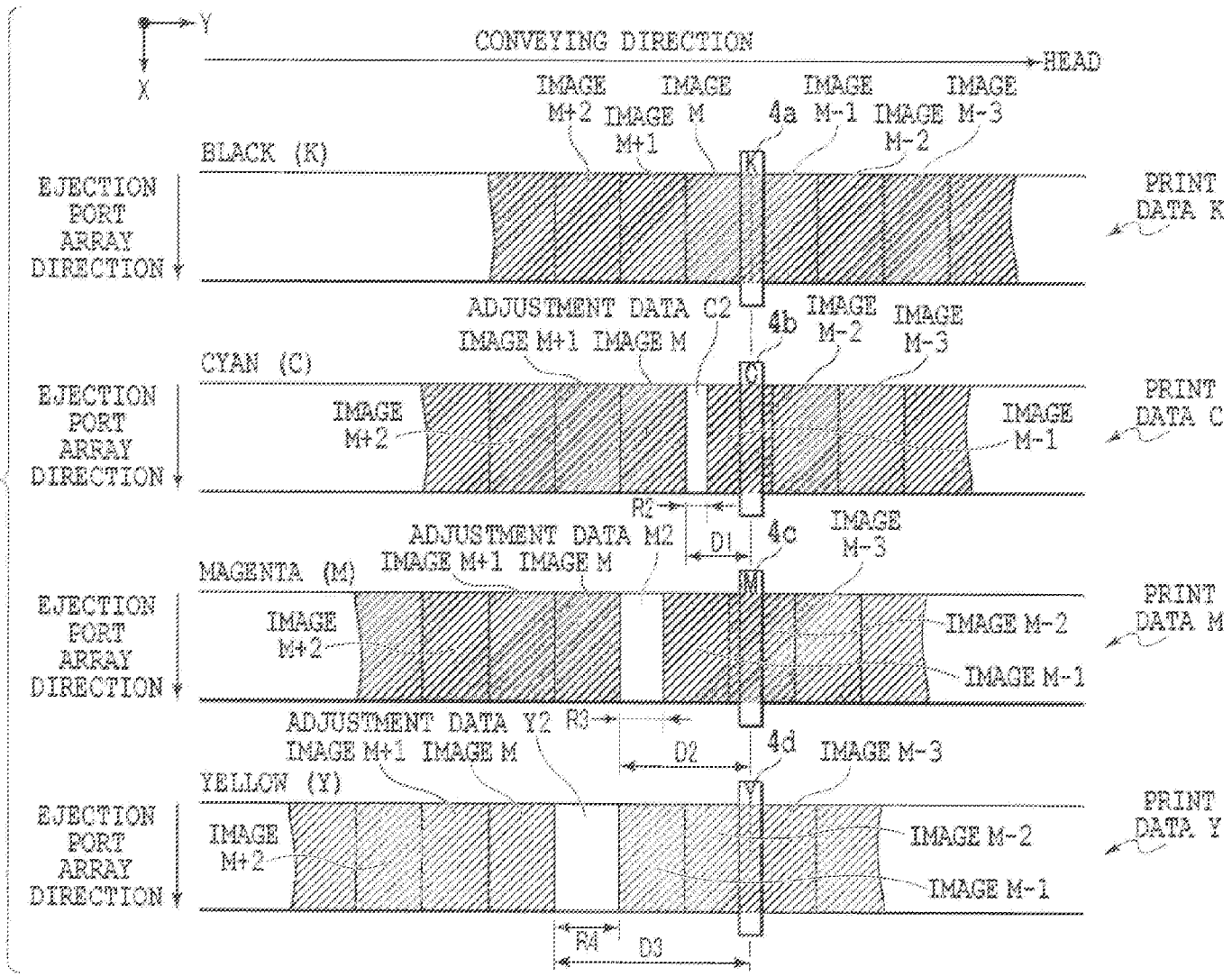
FIG. 9 is a schematic diagram illustrating a case which the states shown in FIGS. 8A to 8D have been corrected.

This method will be described while referring to FIG. 9. FIG. 9 is a schematic diagram illustrating a case which the states shown in FIGS. 8A to 8D have been corrected and the printing positions of the four print heads 4*a* to 4*d* for the image M are matched. In a case that the CPU 201 determines that the conveyance amount of the printing medium 3 is shorter than a desired distance, the CPU 201 adds adjustment data C2 to Y2 for the print data C to Y of the print heads 4*b* to 4*d*, for which a printing position displacement has occurred.

As shown in FIG. 9, in between the image M−1 and the image M, adjustment data C2 corresponding to R2 lines is added for the print head 4*b*, adjustment data M2 corresponding to R3 lines is added for the print head 4*c*, and adjustment data Y2 corresponding to R4 lines is added for the print head 4*d*. The number of R3 lines of the adjustment data M2 is set so greater than the number of R2 lines for the adjustment data C2, while the number of R4 lines for the adjustment data Y2 is set so greater than the number of R3 lines for the adjustment data M2. Since the adjustment data C2 to Y2 are added, the printing start positions of the individual print heads 4*a* to 4*d* for the image M can be aligned on a printing medium, and therefore, the printing position displacement can be corrected.

<A Case which a Conveying Distance is Longer than a Desired Distance>

A case which the conveyance amount of the printing medium 3 is longer than a desired distance will now be described. FIGS. 10A to 10D are schematic diagrams illustrating the print timings in a case that the conveyance amount of the printing medium 3 is longer than that for the case shown in FIG. 7.

When the printing medium 3 has been conveyed the desired distance, the print head 4*b* starts the printing of the image M at the time at which the print head 4*a* begins the printing of the head of the image M+1 (see FIG. 7). However, in a case that the conveyance amount of the printing medium 3 is longer than the desired distance, at the time at which the print head 4*a* begins to print the head of the image M+1, the head of the image M printed by the print head 4*a* has already reached a downstream side than the position of the print head 4*b*.

Figures 10A, 10B, 10C, 10D:
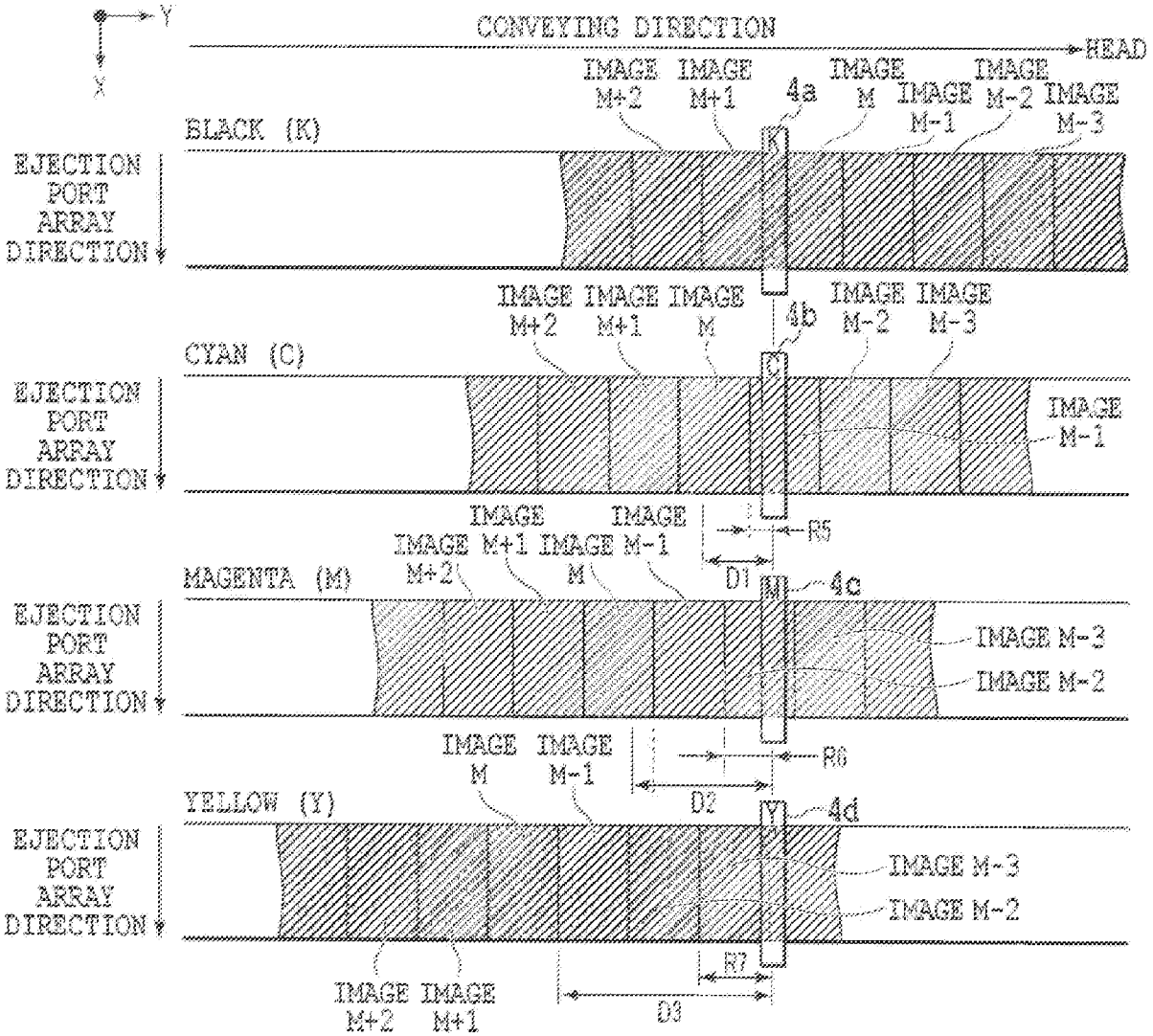
FIG. 10A is a schematic diagram illustrating printing timings in a case that a conveyance amount is longer than that in FIG. 7.
FIG. 10B is a schematic diagram illustrating printing timings in a case that the conveyance amount is longer than that in FIG. 7.
FIG. 10C is a schematic diagram illustrating printing timings in a case that the conveyance amount is longer than that in FIG. 7.
FIG. 10D is a schematic diagram illustrating printing timings in a case that the conveyance amount is longer than that in FIG. 7.

When the head of the image M printed by the print head 4*a* is actually arranged at the printing position of the print head 4*b*, at this time the print head 4*b* is still printing the image M−1 and there are R5 lines not yet printed by the print head 4*b*, as shown in FIG. 10B. Likewise, when the head of the image M−1 printed by the print head 4*a* is actually arranged at the printing position of the print head 4*c*, at this time the print head 4*c* is still printing the image M−2, and there are R6 lines not yet printed by the print head 4*c*, as shown in FIG. 10C. Further, when the head of the image M−2 printed by the print head 4*a* is actually arranged at the printing position of the print head 4*d*, at this time the print head 4*d* is still printing the image M−3, and there are R7 lines not yet printed by the print head 4*d*, as shown in FIG. 10D.

In this embodiment, since adjustment data (null data), consisting of the number of lines needed to correct the position displacement, are added for the print data to be printed by the print heads 4*a* to 4*d*, the printing position displacement is corrected.

Figure 11:
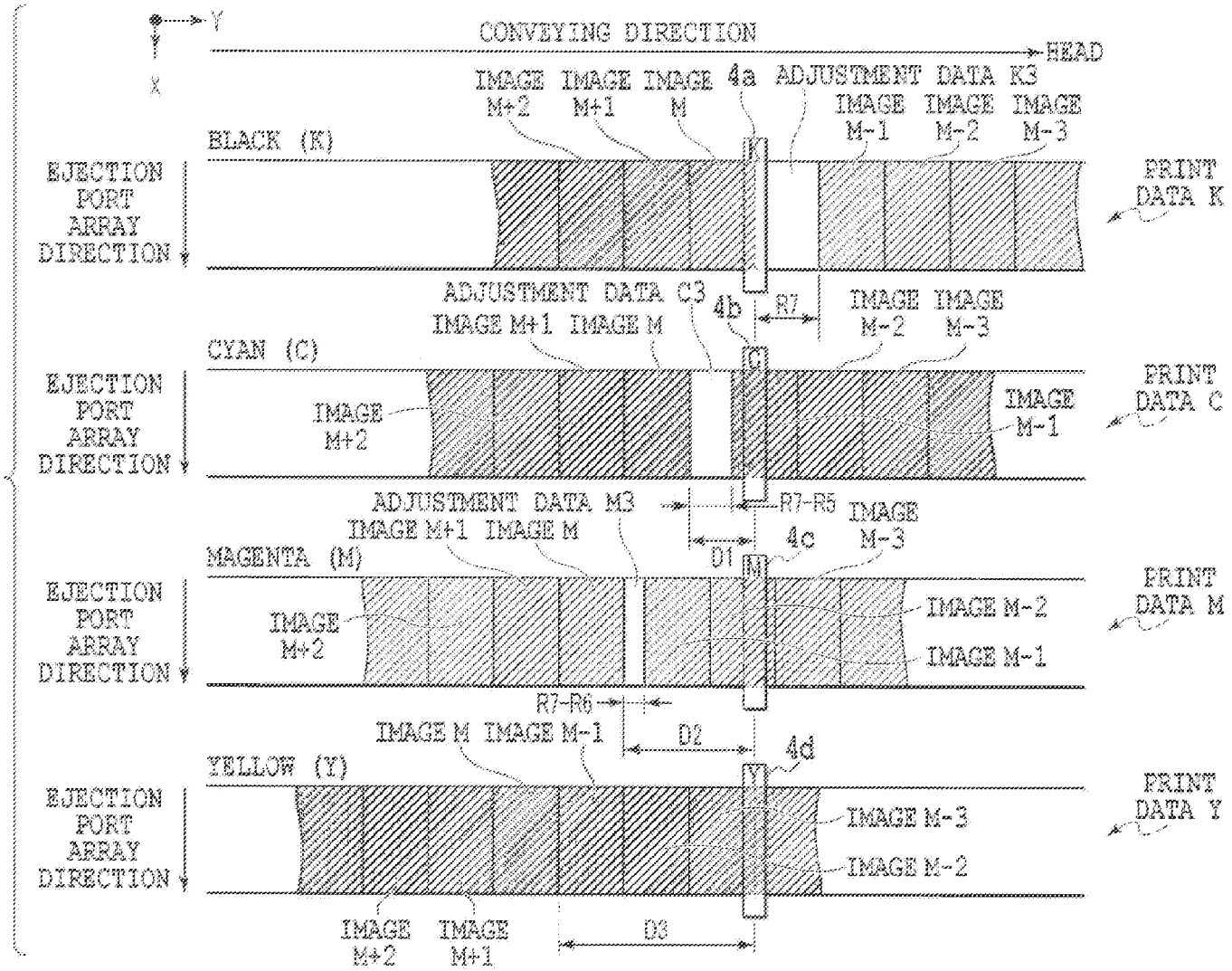
FIG. 11 is a schematic diagram illustrating a case which the states shown in FIGS. 10A to 10D have been corrected.

FIG. 11 is a schematic diagram illustrating a case which the states shown in FIGS. 10A to 10D have been corrected and the printing positions of the four print heads 4*a* to 4*d* for the image M are matched. In a case that the CPU 201 determines that the conveyance amount of the printing medium 3 is longer than a desired distance, the CPU 201 adds adjustment data K3 to M3 for the print data K to M of the print heads 4*a* to 4*c*. As shown in FIG. 11, adjustment data K3 corresponding to R7 lines is added between the image M−1 and the image M for the print head 4*a*, and adjustment data C3 corresponding to (R7−R5) lines is added between the image M−1 and the image M for the print head 4*b*. Furthermore, adjustment data M3, corresponding to (R7−R6) lines, is added between the image M−1 and the image M for the print head 4*c*.

The number of (R7−R5) lines for the adjustment data C3 is set so greater than the number of (R7−R6) lines for the adjustment data M3, while the number of R7 lines for the adjustment data K3 is set so greater than the number of (R7−R5) lines for the adjustment data C3.

Since the adjustment data K3 to M3 are added for the print data K to M, the printing start positions of the individual print heads 4*a* to 4*d* for the image M can be aligned on a printing medium, and therefore, the printing position displacement can be corrected.

In this embodiment, in a case that the conveyance amount of the printing medium 3 is shorter than a desired distance, the number of lines of adjustment data to be added to print data for a print head, located downstream in the conveying direction, should be greater than the number of lines of adjustment data to be added to print data for a print head located upstream in the conveying direction. On the contrary, in a case that the conveyance amount of the printing medium 3 is longer than the desired distance, the number of lines of adjustment data to be added to print data for a print head, located upstream in the conveying direction, should be greater than the number of lines of adjustment data to be added to print data for a print head located downstream in the conveying direction.

As described above, when the number of lines of adjustment data (null data) to be added as an adjustment pattern is appropriately increased or decreased, the printing start positions for the individual print heads can be aligned on a printing medium, and the printing position displacement that has occurred each the print heads (the ejection port arrays) can be corrected.

If the number of lines of data can be adjusted, not only null data but also any other type of data such as solid image data, can be used as an adjustment pattern.

Further, in this embodiment, the inspection unit is located downstream in the conveying direction than a position that a plurality of print heads are located, and detects test patterns that are printed by print heads located upstream in the conveying direction, and that are used to examine the displacement of the printing positions of the print heads. As a result, the printing position displacement is obtained, and adjustment data consisting of lines that correspond to the displacement amount is added to the print data to be printed by the print heads. Through this process, even when the conveyance amount of the printing medium 3 is changed, the printing start positions of the individual ejection port arrays can be adjusted, and the printing position displacement, relative to the reference printing positions, can be corrected. The correction to the printing positions is reflected not only in the image forming portions, but also in the non-image forming portions.

Second Embodiment

In the first embodiment, adjustment data (null data) have been added as an adjustment pattern antecedent to image portions for which positions are to be aligned. According to a second embodiment of the present invention, a method that is using as an adjustment pattern, a non-image portion of print data to be printed by a print head, will be described. In this case, the print head is other than a print head that prints a cut mark pattern that has been prepared in advance.

Figure 12A:
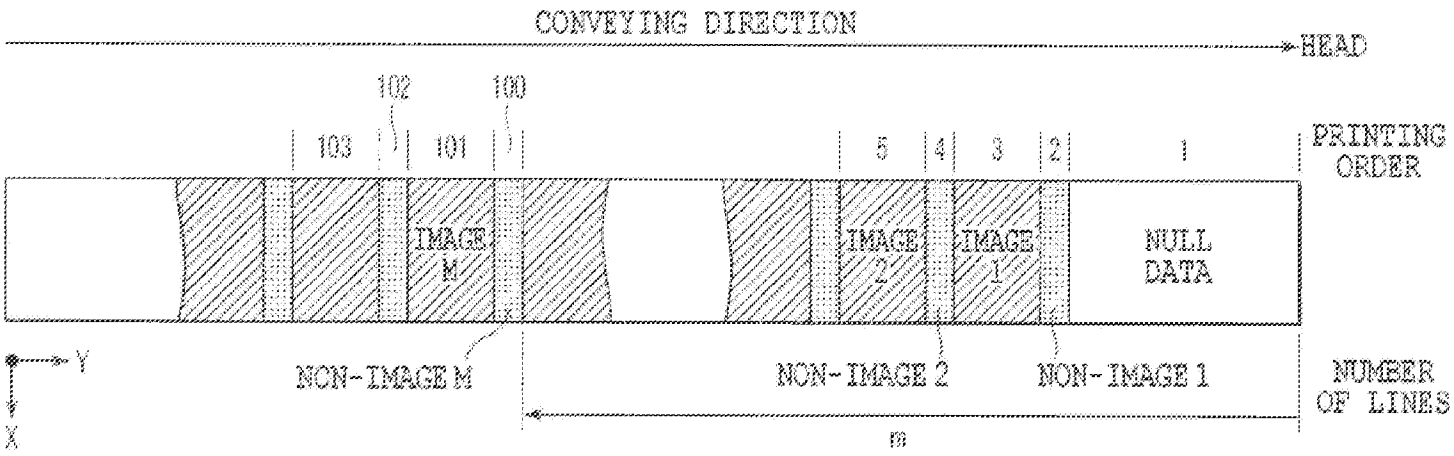
FIG. 12A is a schematic diagram illustrating a print data arrangement state.
Figure 12B:
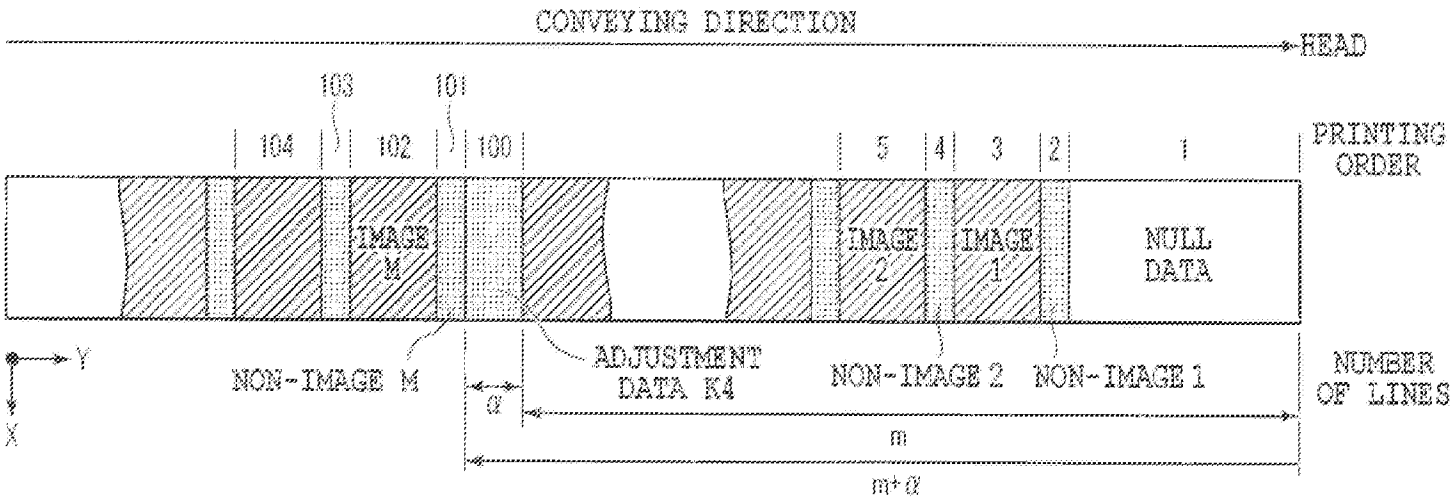
FIG. 12B is a schematic diagram illustrating a print data arrangement state.

FIGS. 12A and 12B are diagrams illustrating the print data arrangement state in a case that a plurality of sequential images is to be printed. In FIGS. 12A and 12B, print data for only a print head 4*a*, one of four print heads, is shown for the sake of simplifying the explanation. FIG. 12A shows the arrangement of data before correcting a printing position. FIG. 12B shows the arrangement of data after correcting a printing position. The corrected print data includes images, non-images, null data and adjustment data. In FIGS. 12A and 12B, the numbers allocated to the individual areas in order, from the first area in the conveying direction, indicate the order in which printing is performed by the print head 4*a*.

The print data is managed by the number of lines in each image at a controller 17. As shown in FIGS. 12A and 12B, a CPU 201 reads print data stored in a RAM 203 or on an HDD 204, in the order a null data, a non-image 1 and an image 1, and sequentially loads the data.

In this embodiment, a cut mark pattern to separate the image portion and the non-image portion is printed at the non-image portion of a predetermined print head. Referring to FIG. 2, a cut mark pattern is printed only by the print head 4*a* of a printing unit 5, and a scanner 7*b* of a cutting unit 8 identifies the cut mark pattern, and a cutting mechanism 9 cuts a printing medium, based on the identified cut mark pattern.

When the m-th line in FIG. 12A is printed, the CPU 201 transmits information for the m-th line to an image processor 207, an engine controller 208 and an individual unit controller 209, and these units perform a corresponding process and control for printing of the m-th line. Since the m-th line indicates a non-image M, the printing unit 5 prints a cut mark pattern. The controller 17 also transmits, to the individual unit controller 209 of the cutting unit 8, a notification concerning the number of lines m where a cut mark pattern is to be arranged, and the individual unit controller 209 effectively switches the scanner 7*b* of the cutting unit 8 in near the number of lines m.

FIG. 12B is a diagram illustrating the arrangement of print data K, into which adjustment data K4 has been inserted. More specifically, FIG. 12B shows the state that the adjustment data K4 (null data) prior to the non-image M in FIG. 12A is added to print data K. When adjustment data K4, corresponding to the number of lines $\alpha$, is added to the print data K, the printing start position of the non-image M is moved to the rear, as shown in FIG. 12B, a distance equivalent to the number of lines $\alpha$ of the adjustment data K4, compared with the position shown in FIG. 12A. That is, the printing start position of the non-image M in FIG. 12A corresponds to the lines m, while the printing position of the non-image M in FIG. 12B corresponds to the lines m+$\alpha$.

As a result, the number of lines that the controller 17 relays to the individual unit controller 209 of the cutting unit 8 must be changed to m+$\alpha$. For the configuration that uses multiple control units that should be individually controlled, it is not desirable that the position (m+$\alpha$) of the pattern that is to be controlled, to be shifted away from the original position (m) during the printing of rolled paper.

Therefore, in this embodiment, to adjust the printing positions of the individual print heads, an adjustment pattern is not added for the print data to be printed by a print head that prints a cut mark pattern that was prepared in advance. Specifically, the non-image portions of print data to be printed by print heads, other than the print head that prints a cut mark pattern, are used as adjustment patterns. As a result, in this embodiment, to adjust the printing position of ejection port arrays, it is not required that an adjustment pattern be added to print data for a print head that prints a cut mark pattern.

Figure 13A:
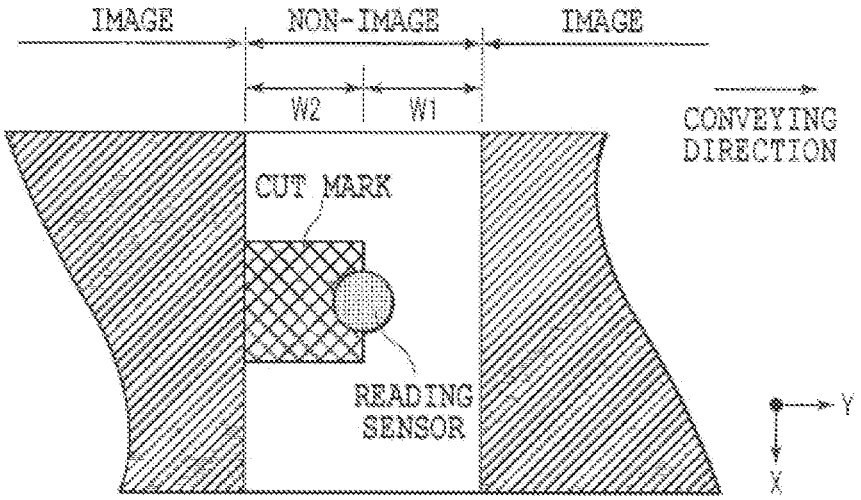
FIG. 13A is a diagram illustrating the positional relationship of a pattern and an optical sensor.
Figure 13B:
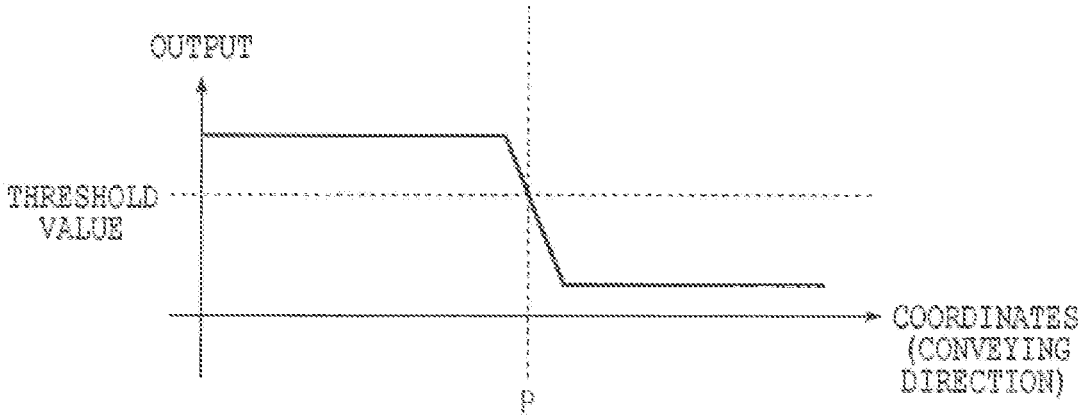
FIG. 13B is a graph illustrating the output level of the optical sensor.

FIG. 13A is a diagram illustrating the positional relationship between a cut mark pattern and an optical sensor (the scanner 7*b*), and FIG. 13B is a diagram illustrating the output level of the optical sensor. As shown in FIG. 13A, a non-image portion used for a cut mark pattern includes an area W2 where a cut mark pattern is to be printed, and a blank area W1. In this embodiment, the cut mark pattern is a solid patch, printed using black ink only. Therefore, for the print heads 4*b* to 4*d*, excluding the print head 4*a* for black ink, the entire area of print data provided for the non-image portion is null data.

When the printing medium 3 is conveyed while the scanner 7*b* is performing detection, a detection value is obtained as shown in FIG. 13B. When a threshold value is provided between the output level at which the scanner 7*b* has scanned the margin portion and the output level at which the scanner 7*b* has scanned the cut mark pattern, passage of the cut mark pattern at the scanner 7*b* can be detected. Then, in this timing, the cutting mechanism 9 cuts the printing medium 3.

A value for a marginal width W1 shown in FIG. 13A is set while taking into account an error in the conveyance amount of the printing medium 3. This setting information is preliminarily stored in the RAM 203 or the HDD 204. The CPU 201 transmits a notification concerning the number of lines which prints a cut mark pattern, to the individual unit controller 209 that controls the cutting unit 8. Upon receiving this notification, the individual unit controller 209 controls the cutting unit 8, when the printing medium 3 of the notified number of lines has been conveyed to the scanning area of the scanner 7*b*, so that scanning by the scanner 7*b* becomes effective. The individual unit controller 209 can also control the cutting unit 8, when a portion of the printing medium 3 other than the portion where the cut mark pattern was printed, has been conveyed to the scanning area of the scanner 7*b*, so that scanning by the scanner 7*b* becomes ineffective.

Figure 14:
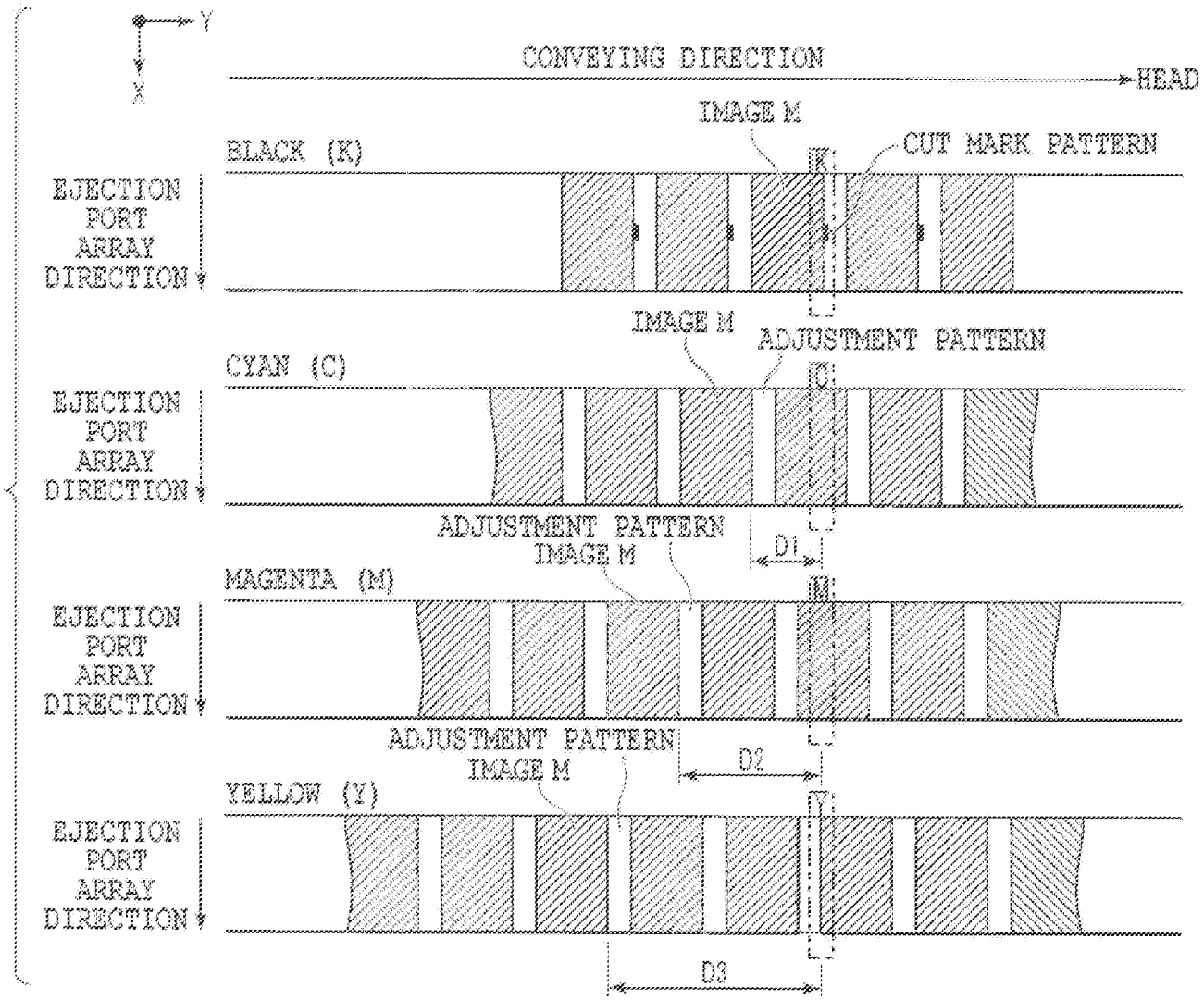
FIG. 14 is a schematic diagram illustrating print data to be printed by the individual print heads according to a second embodiment of the present invention.

FIG. 14 is a schematic diagram illustrating print data to be printed by the print heads 4*a* to 4*d* of this embodiment. As shown in FIG. 14, a cut mark pattern is printed by the print head 4*a*, and the non-image portion of the print head 4*a* that prints a cut mark pattern is always set a predetermined number of lines.

Whereas, the number of lines of the non-image portions of the print heads 4*b* to 4*d* other than the print head 4*a* are adjusted. For example, in a case that the conveyance amount of the printing medium 3 is shorter than a specified distance, lines of null data are added for the non-image portions of the print heads 4*b* to 4*d*. At this time, when the number of lines of the non-image portions of the print heads 4*a* to 4*d* are K, C, M and Y, respectively, null data should be added to establish K<C<M<Y. In a case that the conveyance amount of the printing medium 3 is longer than the specified distance, the number of lines of null data is deleted from the non-image portions of the print heads 4*b* to 4*d*. At this time, the null data is deleted to establish K>C>M>Y.

As described above, according to this embodiment, the addition or the deletion of null data is not performed for the print data to be printed by the print head 4*a*, and the stable position of the non-image portion of the print head 4*a* is maintained. Therefore, the number of lines m that the controller 17 relays to the individual unit controller 209 of the cutting unit 8 is not changed, and the control process will not become complicated. Whereas, since null data is added to or deleted from the non-image portions of print data to be printed by the print heads 4*b* to 4*d*, the number of lines of the non-image portions are appropriately adjusted, and as well as in the first embodiment, the printing positions of the print heads 4*b* to 4*d* can be aligned with the printing position of the print head 4*a*.

As described above, in this embodiment, the non-image portions of the print heads, excluding the print head that prints a cut mark pattern, are used as adjustment patterns, and the number of lines is increased or decreased for the adjustment patterns. As a result, the printing position displacement of the ejection port arrays can be corrected, while complicated control for the cutting unit 8 is not required of the individual unit controller 209. In this embodiment, the print head 4*a* has been used as the print head which prints a cut mark pattern. However, a different print head may also be used. In this case, the number of lines of the non-image portion of the print head that prints a cut mark pattern is fixed, and the number of lines of the non-image portions of the other print heads may be increased or decreased to align the printing positions of these print heads with the printing position of the print head that prints a cut mark pattern.

Furthermore, in this embodiment, a cut mark pattern has been used as an example of a pattern which be printed on the non-image portion. However, another type of pattern can also be effectively used so long as the pattern is printed by using one of the print heads. For example, an alignment pattern may be used, which is used for printing alignment between the obverse side and the reverse side at the time double-sided printing of continuous paper is performed. In this case, if the portion on which the alignment pattern is printed is used as a non-image portion, the same operating effects as the above case which the cut mark pattern is printed, can be provided.

Third Embodiment

In a third embodiment of the present invention, a printing position displacement in the future is predicted on the basis of current printing position displacement, and print data is adjusted based on the predicted displacement. In the first embodiment and the second embodiment, the method of calculating printing position displacements and adding adjustment data corresponding to the printing position displacements to print data has been described. However, in a case that the speed in which a printing medium is conveyed is gradually changed, the amount of adjustment data to be added cannot be uniformly determined. As described above, FIG. 2 is a cross-sectional view of the internal arrangement of the printing apparatus 1, and a test pattern for measuring printing position displacements for the individual print heads is printed by the print heads. Based on this test pattern, the state of the printing positions is examined by the image sensor of the inspection unit 6, and is analyzed by the CPU 201 shown in FIG. 4, and the obtained results are stored in the RAM 203.

At this time, since the inspection unit 6 is distant from the printing unit 5, i.e., there is a distance which is length of the conveying path, a delay (time loss) always occurs after printing has been performed until testing is begun. As the increasing in the size of the printing apparatus continues in future, the distance between the printing unit 5 and the inspection unit 6 tends to be extended. Additionally, with the diversification of the print heads and the complexity of the test pattern, since tend to increase analysis time to analyze the pattern, temporal delay will be also increased. Therefore, in this system configuration, until determining the printing position displacement after inspecting the printed test pattern, a time loss will arise. It is difficult for the above described configuration to adjust the printing position displacement in real time. Whereas, when the adjustment of the printing position displacement is not appropriately performed at the printing time, a deviation of landing positions for the print heads cannot be prevented.

For resolving this problem, in this embodiment, a plurality of test patterns are used to predict a conveying distance, and ink ejection timings are controlled based on the prediction result. That is, a plurality of the previous printing position displacements are obtained, the fluctuations of the displacements is used to predict change in the displacement, an adjustment value is calculated in advance based on the predicted change, and the adjustment value is reflected in print data. In the adjustment of the printing position displacement, since a discrete adjustment value is generally used, a timing which the adjustment value is reflected in the print data is also predicted. Hereinafter, the fluctuation of the printing position displacement and the change of the adjustment value are defined as an "adjustment profile".

<Prediction of Printing Position Displacement>

Figure 16A:
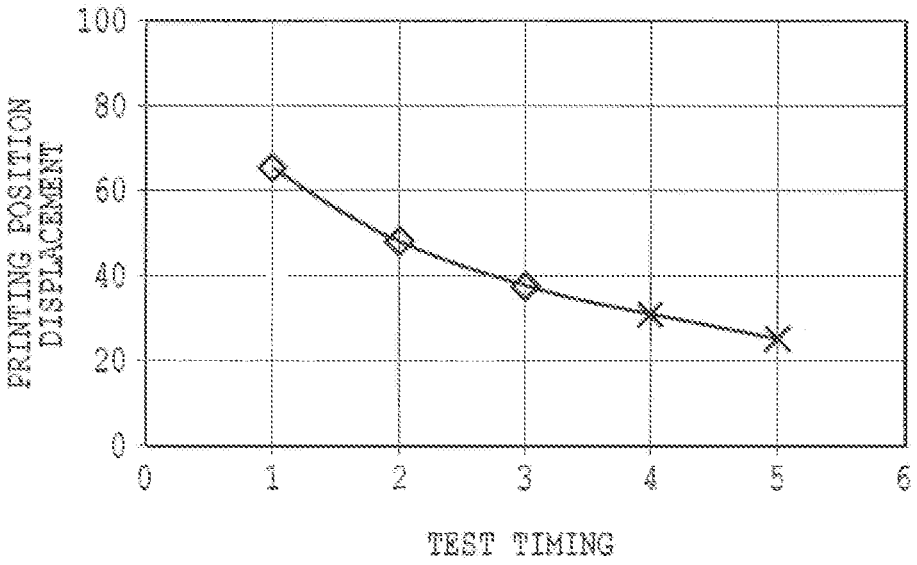
FIG. 16A is an explanatory diagram illustrating a relationship between test timing and a printing position displacement.
Figure 16B:
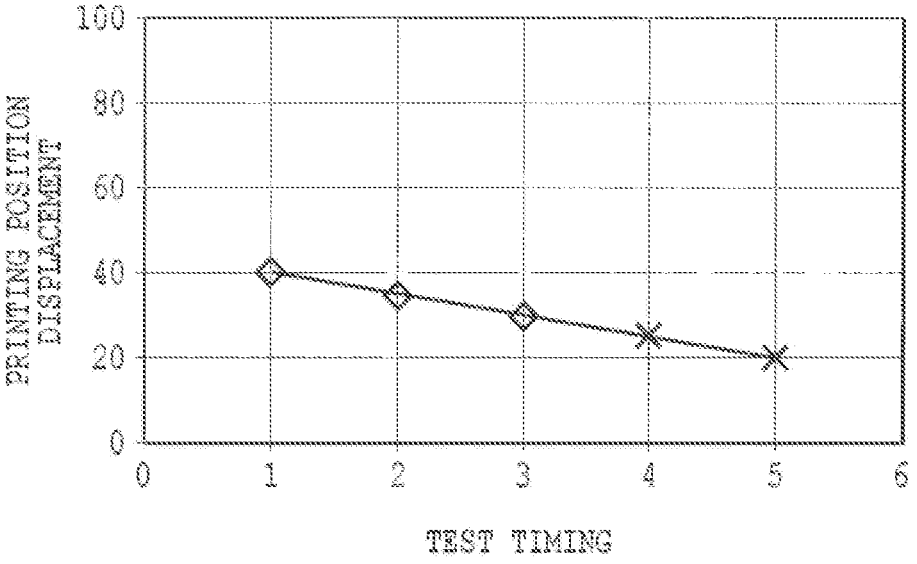
FIG. 16B is an explanatory diagram illustrating a relationship between test timing and a printing position displacement.

A prediction method based on an adjustment profile will now be specifically explained. FIGS. 16A and 16B are graphs showing the printing position displacements in accordance with the test timings of the printing positions. Referring to FIG. 16A, the measurement has been already conducted at test timings 1, 2 and 3, and analysis for the adjustment value is completed in accordance with the printing position displacement, and the adjustment value is represented by a diamond shape ◇ in the graph. Further, the printing position displacements and the adjustment value which are predicted by logarithmic approximation (described later) using these values to predict at test timings 4 and 5, are indicated by x in the graph.

TABLE 1

Printing position displacements at individual test timings, and correlated adjustment values

| | Test Timing | | | | |
|---|---|---|---|---|---|
| | 1 | 2 | 3 | 4 | 5 |
| Printing Position Displacement (μm) | 65 | 48 | 38 | (31) | (25) |
| Adjustment Value (μm) | 63.5 | 42.3 | 42.3 | 21.2 | 21.2 |

Table 1 shows the printing position displacement at each test timing, and correlated adjustment values. Displacements 65, 48 and 38 (μm) at the test timings 1, 2 and 3 are actual measured values, and displacements 31 and 25 (μm) with parenthesis at the test timings 4 and 5 are predicted values. The adjustment values are 63.5, 42.3, 42.3, 21.2 and 21.2 (μm), and since discrete values are used for adjustment, a value with only a small error is selected.

Further, the number of lines that corresponds to the predicted adjustment value and is to be added as adjustment data (null data) is appropriately adjusted, and therefore, even in a case that the conveying speed is gradually changed, the printing position displacements for the print heads (the individual ejection port arrays) can be adjusted. It should be noted that the unit used for the adjustment is 21.2 (μm) equivalent to the width for one pixel which is the minimum unit for 1200 dpi (dot per inch).

Furthermore, in FIG. 16A, the test timing and the adjustment timing are described as the same timings; however, the testing and adjustment may be performed at separate timings. According to the example shown in FIG. 16A, a logarithmic approximation below is used.

$y=a\times\ln(x)+b$ ($a,b$:constant) (approximation 1)

Another prediction method based on an adjustment profile will now be described. While referring to FIG. 16B, measured values are shown at test timings 1, 2 and 3, and predicted values are shown at test timings 4 and 5. The collinear approximation that will be described later is performed by the measured values to perform prediction for the test timings 4 and 5.

TABLE 2

Printing position displacements at individual test timings, and correlated adjustment values

| | Test Timing | | | | |
|---|---|---|---|---|---|
| | 1 | 2 | 3 | 4 | 5 |
| Printing Position Displacement (μm) | 40 | 35 | 30 | (25) | (20) |
| Adjustment Value (μm) | 42.3 | 42.3 | 21.1 | 21.2 | 21.2 |

Table 2 shows the printing position displacement at each test timing in FIG. 16B, and correlated adjustment values. Displacements 40, 35 and 30 (μm) at the test timings 1, 2 and 3 are actual measured values, and displacements 25 and 20 (μm) at the test timings 4 and 5 with parenthesis are predicted values. The adjustment value is 42.3 or 21.3 (μm), and since discrete values are used for adjustment, a value with only a small error is selected. Furthermore, when there is the same tendency for the fluctuation of the displacement, although not shown, it is predicted that the displacement at the test timing 7 will be 10 (μm), and the adjustment value will be 0. That is, the timing for reflecting the adjustment value can also be predicted. According to the example in FIG. 16B, the collinear approximation represented below is used.

$y=a\times x+d$ ($a,b$:constant) (approximation 2)

As described above, appropriate approximations differ depending on the fluctuation of the displacement thus measured.

The characteristic of the approximate curve will now be described. Generally, the logarithmic approximation is the approximate curve appropriate for a case which a change rate of, for example, the measured value is rapidly increased or decreased, and thereafter becomes stable. That is, the logarithmic approximation is appropriate for a case which a phenomenon is the one that a great change occurs and thereafter the state becomes stable. Further, the collinear approximation is appropriate for a change of measured values having a simple linear relationship. That is, the collinear approximation is the approximate curve appropriate for a case which the phenomenon is increased or decreased at a constant ratio. In this embodiment, a case which a change is great and a case which a change is small are separated, and the logarithmic approximation is used for the former case, while the collinear approximation is used for the latter case. In either case, the approximate curve should be appropriately selected depending on the fluctuation of the displacement. When an inflection point is present because there are the increase and the decrease in the change of the displacement, the polynomial approximation is appropriate.

The approximate curves employed are not limited to those described above, and an appropriate curve, including the other approximate curve, should be selected in accordance with the fluctuation.

Figure 17:
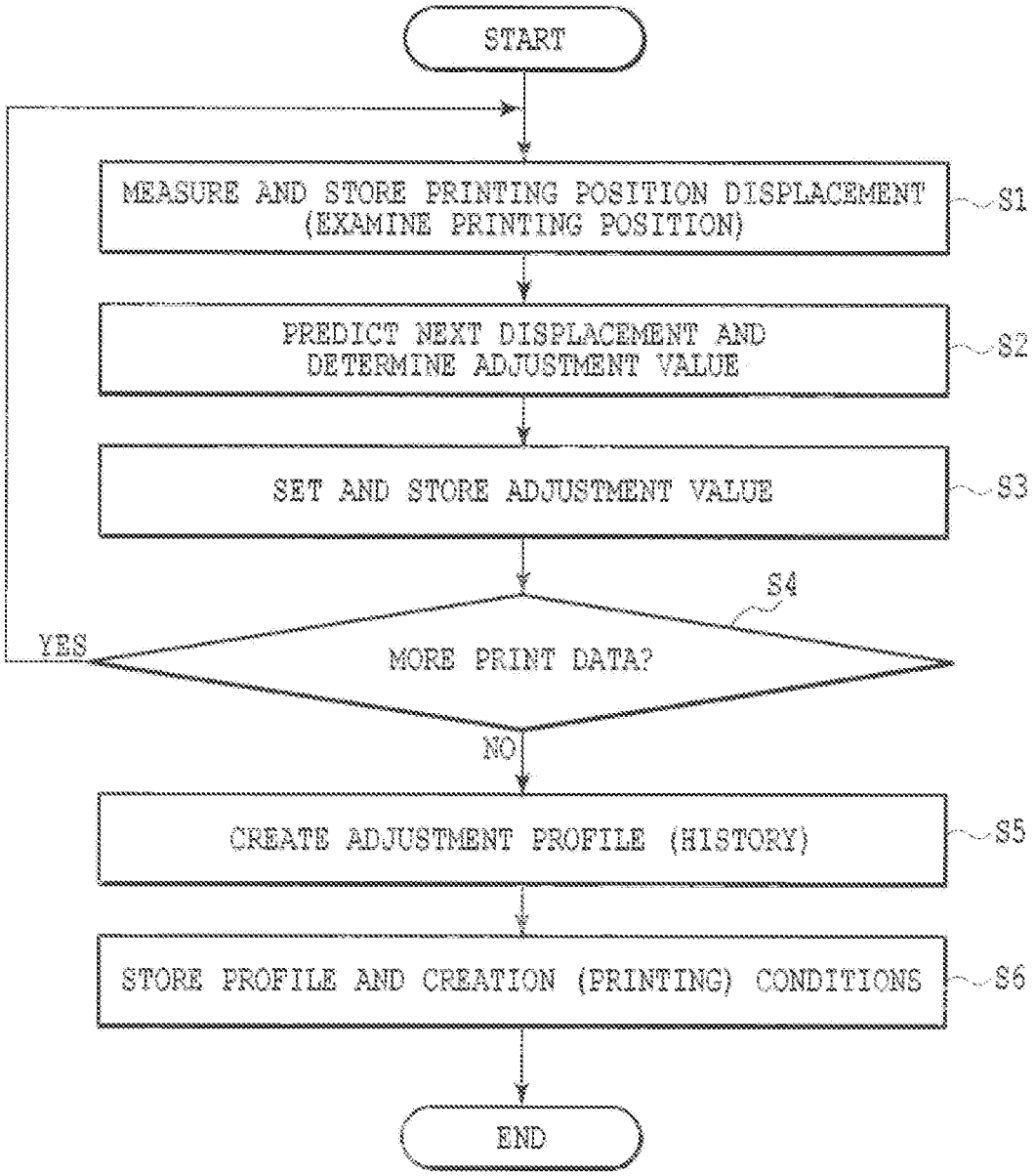
FIG. 17 is a flowchart for explaining the adjustment control performed correspond to a predicted displacement in a third embodiment of the present invention.

The sequence of the control processing performed for this embodiment, from the measurement of the printing position displacement until the prediction of the adjustment value, will now be described while referring to the flowchart in FIG. 17.

First, at step S1, the printing position displacement is measured by using a test pattern, and while the obtained results are stored, the analysis of an adjustment value is repeated by multiple times. It is preferable that a large amount of results be stored if possible; however, from the viewpoint of reducing the time loss as much as possible until the adjustment value is to be reflected, so long as storing of the analysis results is performed by three times, prediction is enabled. At step S2, approximation calculation is performed based on the fluctuation of the displacements that are stored, and the following displacement is predicted to determine a corresponding adjustment value. At step S3, the controller of the printing operation adds adjustment data that corresponds to the determined adjustment value to print data, and performs printing by using the adjusted print data. At step S4, a check is performed to determine whether there are remaining print data, and when there are more print data, program control return to step S1 and the above described printing operation is repeated until there is no more print data. In a case that there is no more print data, at step S5, an adjustment profile that represents the history of the fluctuation of the displacements is prepared and stored. At step S6, the condition for preparing the profile is stored. The processing in this flowchart is thereafter terminated.

The profile creation condition includes the type of a printing medium, the width or length of the printing medium, and the printing environment, and an adjustment profile is created for each creation condition. Furthermore, in this embodiment, the printing position displacement caused by the change of the conveying distance of a single paper roll is corresponded, and the printing position displacement and the adjustment value are stored in correlation with the position in the conveying direction of the paper roll, i.e., in correlation with the area that corresponds to the distance from the leading edge to the trailing edge. Specifically, an example for the printing position displacement and the adjustment value for one roll (conveying length: 60 m) is shown in Table 3.

TABLE 3

Printing position displacements and adjustment values in correlation with distances from the leading edge of rolled paper

| | Distance From Leading Edge (m) | | | | | | | | |
|---|---|---|---|---|---|---|---|---|---|
| | 0 | 4 | 8 | 12 | 16 | . . . | 52 | 56 | 60 |
| Printing Position Displacement (μm) | 0 | 65 | 48 | 38 | 31 | . . . | 30 | 35 | 40 |
| Adjustment Value (μm) | 0 | 63.5 | 42.3 | 42.3 | 21.2 | . . . | 21.2 | 42.3 | 42.3 |

It is apparent from Table 3 that, when the rolled paper has begun to use, the printing position displacement is great, and as the usage of the rolled paper is continued, the printing position displacement is gradually reduced. Further, it is also found that the state becomes stable when the distance from the leading edge is near 16 (m), and the displacement is increased again near the trailing edge of the rolled paper.

As an adjustment value, a discrete value having less error is selected in accordance with the printing position displacement. It is apparent from Table 3 that the logarithmic approximation is preferable for prediction in a case that the printing operation is performed using the leading edge portion and the trailing edge portion of the rolled paper, while the collinear approximation is preferable for prediction in a case that the printing operation is performed by using the intermediate area of the rolled paper.

The conveying distance for the leading edge of the roll paper tends to be changed due to the moisture content of the printing medium. Further, since the trailing edge of the roll paper is close to the core of the roll, the movement of the roll paper becomes unstable, and therefore, the conveying distance tends to be changed. In both cases, the resistance of the roller against the conveying movement is reduced, and the conveying speed is increased, so that the conveying distance would be increased.

Further, the printing position displacement and the adjustment value may be influenced also by the type, the width and the length of the printing medium and the storage environment, and therefore, preferably, an adjustment profile should be stored for each creation condition. Therefore, the characteristics of the individual printing apparatuses can be stored in accordance with the printing medium condition and the printing environment, and can be used for analysis for the occurrences of troubles. Furthermore, since the start of the movement of the printing medium may be unstable due to the effect of the operation of the printing apparatus, the adjustment value may be required at the beginning of the sequential printing. In such a case, an adjustment profile may be prepared for sequential printing, and may be used separately from an adjustment profile prepared for rolled paper.

As described above, in this embodiment, printing position displacement is detected by multiple times for one of the print heads that is used as a reference print head, and the fluctuation of the displacements is used to predict the following displacement. Then, non-image data (adjustment data) consisting of the number of lines which is determined in consonance with an adjustment value that is obtained based on the predicted value, is added to print data at an appropriate timing, and the thus adjusted print data is used to perform the printing operation. As a result, when the conveying distance of the printing medium is gradually changed, the landing positions of dots that are ejected by the print heads are controlled so does not shift.

Fourth Embodiment

In the third embodiment, the fluctuation of the printing position displacements is used to predict the following displacement, and determine a corresponding adjustment value. However, since there are no results or few results for the displacement for the leading edge of the roll paper, the displacement in future cannot be predicted based on the previous fluctuation. Therefore, in this embodiment, from adjustment profiles prepared in advance, an appropriate adjustment profile is selected in accordance with the printing condition, and appropriate adjustment is performed based on the selected adjustment profile. The adjustment profile is an adjustment table where a correlation is entered between a distance from the leading edge of a roll-shaped printing medium to the print start position and the printing position deviation that might occur at this time, and is stored in a memory in advance. A plurality of such adjustment tables are prepared to cope with types of media, the widths and lengths of the printing media and printing environments. The adjustment profile prepared in the third embodiment may be used for this embodiment.

Figure 18:
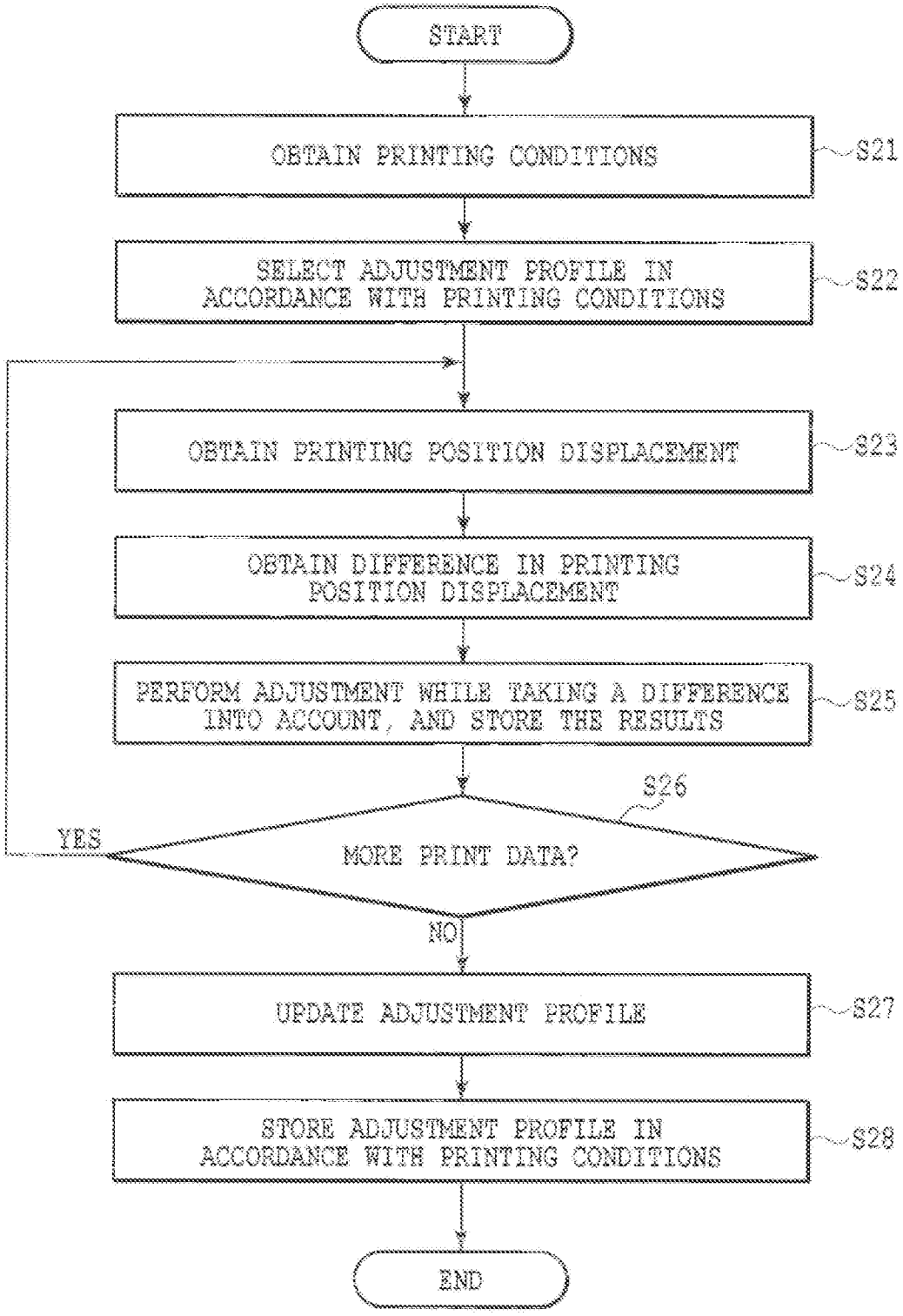
FIG. 18 is a flowchart for explaining the adjustment control performed in a fourth embodiment of the present invention.

The sequence of the control processing until examination of the adjustment profile and the printing positions will now be described. FIG. 18 is a flowchart for adjusting the printing positions using an adjustment profile. First, at step S21, the printing conditions such as the type of a printing medium, the width and length of the printing medium and the printing environment, are obtained, and at step S22, an adjustment profile suitable for the printing conditions is selected from a plurality of adjustment profiles stored in advance.

At step S23, a test pattern is obtained at the printing position, and the printing position displacement is obtained. In this process, the actual printing position displacement is compared with the printing position displacement and the adjustment value which are assumed in the adjustment profile.

At step S24, the printing position displacement measured at step S23 is compared with the printing position displacement obtained from the adjustment profile, and a difference of the two is obtained. At step S25, the difference is analyzed to determine whether a change of the adjustment value obtained from the adjustment profile, is required, and as needed, the adjustment value is changed, and adjustment data (null data) that corresponds to the updated adjustment value is added to print data. Thereafter, the printing operation is performed based on the adjusted print data.

At this time, when a difference between the predicted displacement in the adjustment profile and the actual printing position displacement is a value once or twice of the unit of adjustment, or smaller, the value is unchanged, and the print data is adjusted based on the profile that is designated. When a difference is a value greater than twice of the unit of adjustment, the updated adjustment value in the adjustment profile is used to adjust the print data.

At step S26, a check is performed to determine whether there are more print data, and when there are more print data, program control returns to step S23, and the printing operation described above is repeated until no more print data remain. When there are no more print data, and when the change of the adjustment value is required, at step S27, the adjustment profile is updated. At step S28, the adjustment profile updated in accordance with the printing conditions is stored, and the processing is terminated.

It should be noted that, at step S25, the change of the adjustment value may be performed in a case that a difference of the printing position displacements is greater than a specific value, and this state is continued by multiple times, and such a change may not be performed in a case that the printing position displacement has occurred for only one position.

Furthermore, when the printing apparatus has been used for an extended period of time, the conveying capability may be deteriorated, and therefore, correction of the adjustment profile may be performed in accordance with the usage period of the printing apparatus.

As described above, from a plurality of adjustment profiles prepared in advance, an adjustment profile regarded as appropriate is selected based on the printing conditions, and the printing position displacement is examined for one of the print heads that is used as a reference. Then, a difference between the printing position displacement obtained in the selected adjustment profile and the actually measured displacement is used to determine whether the adjustment value in the adjustment profile is appropriate, or should be changed. Thereafter, when printing is performed by adding non-data consisting of the number of lines that corresponds to the obtained adjustment value to print data, deviation of the landing positions of dots that are ejected by the print heads can be avoided even when the conveying distance of the printing medium is gradually changed at the leading edge of the rolled paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2012-128895, filed Jun. 6, 2012 and 2012-260071, filed Nov. 28, 2012, which are hereby incorporated by reference herein in their entirety.

What is claimed is:

1. An image processing apparatus for an ink jet printing apparatus to print images on a printing medium by using at least two nozzle arrays, each of which includes multiple nozzles arranged in a nozzle arranging direction crossing a conveying direction of the printing medium, such that a non-image area is provided on the print medium between image areas on which the images are printed, comprising:

a detecting unit configured to detect a relative printing position displacement between print positions by the at least two nozzle arrays in the conveying direction; and a correcting unit configured to correct the printing position displacement by adding adjustment data corresponding to the detected printing position displacement to data for the non-image area for at least one nozzle array of the at least two nozzle arrays so as to adjust a number of lines of the non-image area on the at least one nozzle array, the line extending in the nozzle arraying direction, to align the relative printing position between print positions by the at least two nozzle arrays.

2. The image processing apparatus according to claim 1, wherein the inkjet printing apparatus prints on the printing medium by using a plurality of the nozzle arrays arranged in the conveying direction comprising nozzle array other than the at least two nozzle arrays, the detecting unit detects a printing position displacement with respect to a printing position of a reference nozzle array on the printing medium for each of remaining nozzle arrays excluding the reference nozzle array which is one of the plurality of nozzle arrays, and the correcting unit corrects the printing position displacement by adding non-image data corresponding to the detected printing position displacement to print data for non-image area for the remaining nozzle arrays so as to align the printing positions of the plurality of nozzle arrays.

3. The image processing apparatus according to claim 2, wherein the printing medium is continuous paper and a cut mark pattern indicating a position to cut the continuous paper is printed on the non image area of the printing medium by the reference nozzle array without using the remaining nozzle arrays.

4. The image processing apparatus according to claim 1, further comprising a printing unit having at least two nozzle arrays configured to print images on the printing medium based on print data corrected by the correcting unit.

5. The image processing apparatus according to claim 1, wherein a pattern is printed on the non-image area of the printing medium, the pattern is to be read by an optical sensor which is located in the conveying direction downstream from the plurality of nozzle arrays.

6. The image processing apparatus according to claim 5, wherein the printing medium is continuous paper and the pattern is a cut mark pattern indicating a position to cut the continuous paper.

7. The image processing apparatus according to claim 6, wherein a nozzle array other than the at least one nozzle array of the at least two nozzle arrays prints the cut mark pattern on the non-image area and the correcting unit does not add the adjustment data to the data for the non-image area for the nozzle array other than the at least one nozzle array.

8. The image processing apparatus according to claim 5, wherein the printing medium is continuous paper and the pattern is a pattern used for position alignment with the obverse side and the reverse side of the continuous paper before printing is to be performed on the reverse side.

9. The image processing apparatus according to claim 5, further comprising an inspection unit including the optical sensor, wherein the pattern is used for the relative printing position displacement printed by the at least two nozzle arrays and the detecting unit detects the printing position displacement based on inspecting an result obtained by the inspection unit.

10. The image processing apparatus according to claim 1, further comprising:

a predicting unit configured to predict a succeeding printing position displacement based on the printing position displacement detected by the detecting unit; and an adjusting unit configured to adjust print data used for printing by at least one nozzle array of the at least two nozzle arrays based on predicted printing position displacement.

11. The image processing apparatus according to claim 10, wherein the adjusting unit adjusts print data by adding non-image data corresponding to the predicted printing position displacement to the print data for at least one nozzle array of the at least two nozzle arrays.

12. The image processing apparatus according to claim 10, wherein the predicting unit predicts the printing position displacement by using an approximation.

13. The image processing apparatus according to claim 10, wherein the printing medium is a roll-shaped printing medium, and the predicting unit predicts the printing position displacement for performing printing at a leading edge portion and a trailing edge portion of the roll-shaped printing medium by using a logarithmic approximation, and predicts the printing position displacement for performing printing at an intermediate portion of the roll-shaped printing medium by using a collinear approximation.

14. The image processing apparatus according to claim 10, further comprising a storing unit configured to store as an adjustment table a history for the printing position displacement detected by the detecting unit.

15. The image processing apparatus according to claim 1, wherein, in a case where a conveying amount of the print medium indicated by the detected relative printing position displacement is smaller than a specified conveying amount, the correcting unit adds the adjustment data to print data for the non-image area for the at least one nozzle array of the at least two nozzle arrays such that the number of lines of the non-image area on the at least one nozzle array is smaller than the number of lines of the non-image area on the nozzle array other than the at least one nozzle array.

16. The image processing apparatus according to claim 1, wherein, in a case where a conveying amount of the print medium indicated by the detected relative printing position displacement is longer than a specified conveying amount, the correcting unit deletes data for the non-image area for the at least one nozzle array of the at least two nozzle arrays such that the number of lines of the non-image area on the at least one nozzle array is greater than the number of lines of the non-image area on the nozzle array other than the at least one nozzle array.

17. A control method for an ink jet printing apparatus to print images on a printing medium by using at least two nozzle arrays, each of which includes multiple nozzles arranged in a nozzle arranging direction crossing a conveying direction of the printing medium, such that a non-image area are provided on the print medium between image areas on which the images are printed, comprising:

a step of detecting a relative printing position displacement between print positions by the at least two nozzle arrays in the conveying direction; and a step of correcting the printing position displacement by adding adjustment data corresponding to the detected printing position displacement to data for the non-image area for at least one nozzle array of the at least two nozzle arrays so as to adjust a number of lines of the non-image area on the at least one nozzle array, the line extending in the nozzle arraying direction, to align the relative printing position between print positions by the at least two nozzle arrays.

18. The control method according to claim 17, wherein non-image data for the reference nozzle array is fixed, and non-image data corresponding to the printing position displacement are added to print data used for printing by at least one nozzle array other than the reference nozzle array.

19. The control method according to claim 17, wherein a pattern is printed on the print medium, the pattern is to be read by an optical sensor which is located in the conveying direction downstream from the plurality of nozzle arrays.

20. The control method according to claim 19, wherein the printing medium is continuous paper and the pattern is a cut mark pattern indicating a position to cut the continuous paper.

21. The control method according to claim 19, wherein the printing medium is continuous paper and the pattern is a pattern used for position alignment with the obverse side and the reverse side of the continuous paper before printing is to be performed on the reverse side.

22. The control method according to claim 19, wherein the step of detecting detects the printing position displacement based on inspecting a result obtained by an inspection unit including the optical sensor.

23. The control method according to claim 17, further comprising:

a step of predicting a succeeding printing position displacement based on the printing position displacement detected by the detecting unit; and a step of adjusting print data used for printing by at least one nozzle array of the at least two nozzle arrays based on predicted printing position displacement.

24. The control method according to claim 23, wherein the step of adjusting adjusts print data by adding non-image data corresponding to the predicted printing position displacement to the print data for at least one nozzle array of the at least two nozzle arrays.

25. The control method according to claim 23, wherein the step of predicting predicts the printing position displacement by using an approximation.

* * * * *